US008959836B2

(12) United States Patent
Gayhart

(10) Patent No.: US 8,959,836 B2
(45) Date of Patent: Feb. 24, 2015

(54) SLIDING SECURITY DOOR

(75) Inventor: Gary Gayhart, Racine, WI (US)

(73) Assignee: Hydra DoorCo LLC, Racine, WI (US)

( * ) Notice: Subject to any disclaimer, the term of this patent is extended or adjusted under 35 U.S.C. 154(b) by 61 days.

(21) Appl. No.: 13/081,978

(22) Filed: Apr. 7, 2011

(65) Prior Publication Data

US 2012/0255232 A1 Oct. 11, 2012

(51) Int. Cl.

| | |
|---|---|
| ***E05B 65/10*** | (2006.01) |
| ***E05F 15/06*** | (2006.01) |
| ***E05B 65/00*** | (2006.01) |
| ***E05F 15/20*** | (2006.01) |
| ***E06B 3/46*** | (2006.01) |
| *E05F 17/00* | (2006.01) |

(52) U.S. Cl.

CPC ..... *E05F 15/06* (2013.01); *E05B 65/0017* (2013.01); *E05F 15/2015* (2013.01); *E06B 3/4654* (2013.01); *E05F 17/001* (2013.01); *E05Y 2400/612* (2013.01); *E05Y 2800/252* (2013.01); *E05Y 2900/10* (2013.01); *E05Y 2900/14* (2013.01)

USPC ..... 49/141; 49/360

(58) Field of Classification Search

USPC ..... 49/141, 360, 362

See application file for complete search history.

(56) References Cited

U.S. PATENT DOCUMENTS

| | | | | |
|---|---|---|---|---|
| 3,866,354 | A * | 2/1975 | Butt | 49/16 |
| 3,913,263 | A * | 10/1975 | Butt | 49/16 |
| 3,961,447 | A | 6/1976 | Wolz | |
| 4,046,167 | A | 9/1977 | Papp et al. | |
| 4,290,368 | A * | 9/1981 | Mazzini | 105/341 |
| 4,621,451 | A | 11/1986 | Bruehler | |
| 4,641,458 | A * | 2/1987 | Pilcher et al. | 49/20 |
| 4,653,227 | A | 3/1987 | Condon et al. | |
| 4,901,474 | A * | 2/1990 | Bayard et al. | 49/26 |
| 4,982,528 | A * | 1/1991 | Michel | 49/16 |
| 5,177,988 | A | 1/1993 | Bushnell | |
| 5,241,787 | A * | 9/1993 | Norman | 49/16 |
| 5,422,552 | A * | 6/1995 | Parisi | 318/466 |
| 5,758,453 | A * | 6/1998 | Inage | 49/118 |
| 5,878,530 | A * | 3/1999 | Eccleston et al. | 49/139 |
| 5,921,604 | A | 7/1999 | Yu et al. | |
| 6,019,397 | A | 2/2000 | Baudu et al. | |
| 6,314,728 | B1 | 11/2001 | Schilling et al. | |
| 6,581,333 | B2 | 6/2003 | Kimball | |
| 6,585,303 | B1 * | 7/2003 | Coose et al. | 292/144 |
| 6,957,721 | B2 | 10/2005 | Moser | |
| 2005/0224193 | A1 | 10/2005 | Nelzi | |
| 2007/0000622 | A1 * | 1/2007 | Reed et al. | 160/188 |
| 2008/0209811 | A1 | 9/2008 | Bienek | |
| 2008/0226391 | A1 * | 9/2008 | Phillips et al. | 404/6 |
| 2012/0060419 | A1 * | 3/2012 | Riggs | 49/18 |

* cited by examiner

*Primary Examiner* — Katherine Mitchell
*Assistant Examiner* — Scott Denion
(74) *Attorney, Agent, or Firm* — Jansson Munger McKinley & Shape Ltd.

(57) ABSTRACT

A sliding door apparatus for closing and opening in a wall. The sliding door apparatus includes a sliding door having top and bottom edges, a door frame, a carriage secured to the top edge of the door and a drive mechanism for opening and closing movement of the door. The drive mechanism preferably includes a bi-directional effector, a power-storing power source and a controller configured to enable the door to be continuously closed but not locked when a continuously-closed signal is received by the controller.

15 Claims, 20 Drawing Sheets

INPUTS:
CDIS = CLOSED AND DEADLOCKED INPUT SWITCH
CUIS = CLOSED AND UNLOCKED INPUT SWITCH
OUIS = OPEN AND UNLOCKED INPUT SWITCH
ODIS = OPEN AND DEADLOCKED INPUT SWITCH
FEI = FIRE MODE ENABLE INPUT
FDI = FIRE MODE DISABLE INPUT
CDI = CLOSE AND DEADLOCK COMMAND INPUT
CUI = CLOSE AND UNLOCK COMMAND INPUT
OUI = OPEN AND UNLOCK COMMAND INPUT
ODI = OPEN AND DEADLOCK COMMAND INPUT
LPIS = LOW PRESSURE INPUT SWITCH
HPIS = HIGH PRESSURE INPUT SWITCH

OUTPUTS:
CDO = CLOSED AND DEADLOCKED OUTPUT
CUO = CLOSED AND UNLOCKED OUTPUT
OUO = OPENED AND UNLOCKED OUTPUT
ODO = OPENED AND DEADLOCKED OUTPUT
CLSO = DOOR CLOSING RELAY OUTPUT
OPNO = DOOR OPENING RELAY OUTPUT
CMPO = COMPRESSOR RELAY OUTPUT
DPO = DEALOCK PREVENTION OUTPUT
DO = DEALOCK OUTPUT

LATCHING SOLENOIDS:
DPS = DEADLOCK PREVENTION SOLENOIDS

INTERNAL RELAYS:
CD = CLOSED AND DEADLOCKED
CU = CLOSED AND UNLOCKED
OU = OPENED AND UNLOCKED
OD = OPENED AND DEADLOCKED
FE = FIRE MODE ENABLED
FD = FIRE MODE DISABLED
CDC = CLOSE AND DEADLOCK COMMAND
CUC = CLOSE AND UNLOCK COMMAND
CURC = CLOSE AND UNLOCK REVERSED COMMAND
OUC = OPEN AND UNLOCK COMMAND
OURC = OPEN AND UNLOCK REVERSED COMMAND
ODC = OPEN AND DEADLOCK COMMAND
DPC = DEADLOCK PREVENTION COMMAND (ONE-SHOT)
DC = DEADLOCK COMMAND (ONE-SHOT)
LP = LOW PRESSURE RELAY
HP = HIGH PRESSURE RELAY
RUNC = COMPRESSOR RELAY
DPR = DEADLOCK PREVENTION RELAY
DR = DEADLOCK RELAY

WIRED RELAYS:
CLS = CLOSING POWER RELAY
OPN = OPENING POWER RELAY
RM = RUN MOTOR RELAY

FIG. 9A

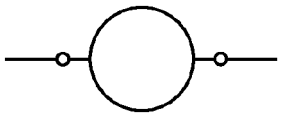

Wired-relay coil or a command signal or a logic level of an internal relay (not a physical device) or an output signal.

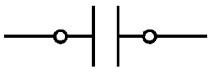

Normally-open contacts. Initials ending in an "I" or an "IS" indicate an external input. Initials ending in an "O" indicate an output signal. When a wired relay is energized or an internal relay is set, these contacts are closed or set.

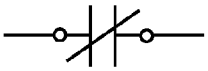

Normally-closed contacts. When a relay is energized, these contacts are opened.

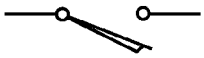

Normally-open contacts on input switches.

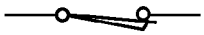

Normally-closed contacts on input switches.

FIG. 9B

SLIDING SECURITY DOOR

FIELD OF THE INVENTION

This invention relates generally to sliding doors and, more particularly, to sliding doors which may be used in facilities in which high security is an important requirement of the intended performance of the doors.

BACKGROUND OF THE INVENTION

High-security door devices which slide between an open and a closed position and which are used in detention or military facilities are well known in the art. Such doors are regulated by varying code requirements. The National Fire Protection Association ("NFPA") mandates that under an emergency condition, doors shall not relock upon closing. (NFPA Life Safety Code, Section 101.) NFPA section 80 states that if a door has a self-closing feature achieved by powered operation, the door shall be capable of performing the self-closing feature for a minimum of 50 cycles when power service is lost.

Currently there is not a sliding security door device which can satisfy these standards; the corrections industry is in need of a detention sliding door device which meets the operations requirements of both life and fire-safety as mandated by the various codes.

There are a few security hardware manufacturers which provide corridor sliding door devices to the detention industry. All of these manufacturers fabricate sliding doors that open and close with the use of an electric rack and pinion, electric chain, or pneumatic drive. All of these prior art devices have a wheeled carriage that supports the detention door. The carriage moves across the opening by a sliding travel bar that deadlocks a vertical lock bar at the fully-closed or fully-open positions. All of these prior art devices deadlock the sliding door at the location of both the carriage and the bottom door guide.

These sliding door devices are generally used to control movement within detention or military facilities. This movement is along the paths of ingress and egress from the institutional buildings. A significant shortcoming of the prior art is that none of these devices meet the life safety requirements for emergency egress from such buildings. The prior art devices are configured to open and close with power applied. Another shortcoming is that if power is lost to the device, the doors do not have the ability to reclose in an emergency egress situation. A manual key may be used to override the deadlock and allow the door to be opened, but in the manual mode the door will stay at whatever position it is at when the manual operating effort has stopped, whether that be in an open or closed position. This invention disclosed herein meets these needs and overcomes other problems and shortcomings of the prior art.

The sliding door device disclosed in this application operates primarily as a corridor sliding door device with substantial improvements over the devices of the prior art. When placed into the emergency mode, the device disclosed herein will remove the deadlock in either the open or closed positions. The door will be powered to close, and the door will be allowed to open by overriding the closing pressure. When released, the door will move to the fully-closed position. The device disclosed herein is a "Life Safety" sliding door device that allows for egress movement upon closing. The door structure itself may provide a fire rating to meet various code requirements.

OBJECTS OF THE INVENTION

It is an object of the invention, in the field of sliding door devices, to provide a device which overcomes certain problems of the prior art, including those mentioned above.

Another object of the invention is to provide an improved sliding door device which meets regulatory life and fire-safety codes.

Another object of the invention is to provide an improved sliding door device which is able to operate during power periods of loss.

Still another object of the invention is to provide an improved sliding door device which is powered by hydraulic, pneumatic or electric power.

These and other objects of the invention will be apparent from the following descriptions and from the drawings.

SUMMARY OF THE INVENTION

This invention is a sliding door apparatus for closing and opening in a wall. The sliding door apparatus of this invention includes a sliding door having top and bottom edges, a door frame having a track adjacent to the top edge of the door, a carriage secured to the top edge of the door and having track-engaging rollers and a drive mechanism for opening and closing movement of the door. The drive mechanism preferably includes a bi-directional effector secured with respect to the frame and driving the door, a power-storing power source and a controller configured to enable the door to be continuously closed but not locked when a continuously-closed signal is received by the controller.

In highly-preferred embodiments, the controller includes a plurality of limit sensors which detect a plurality of door positions.

Preferably, the bi-directional effector can have various embodiments such as a hydraulic motor, hydraulic cylinder, pneumatic motor, pneumatic cylinder or an electric motor. In certain preferred embodiments, the bi-directional effector is a hydraulic motor and the apparatus further includes an electrically-driven hydraulic pump secured with respect to the frame, a rack secured with respect to the slide plate, a pinion driven by the hydraulic motor and engaging the rack and the power-storing power source is an electrical uninterruptible power supply.

In certain preferred embodiments, the bi-directional effector is a hydraulic cylinder having a piston and the apparatus further includes an electrically-driven hydraulic pump secured with respect to the frame. The piston is secured with respect to the slide plate, and the power-storing power source is an electrical uninterruptible power supply.

In other preferred embodiments, the bi-directional effector is a pneumatic motor and the apparatus further includes a pneumatic connection to a compressed air source, the connection being secured with respect to the frame, a rack secured with respect to the slide plate, and a pinion driven by the pneumatic motor and engaging the rack.

Still in other preferred embodiments, the bi-directional effector is a pneumatic cylinder having a piston and the apparatus further includes a pneumatic connection to a compressed air source, the connection being secured with respect to the frame and the piston is secured with respect to the slide plate.

In another preferred embodiment, the bi-directional effector is an electric motor and the apparatus further includes a mechanical linkage between the electric motor and the slide plate, and the power-storing power source is an electrical uninterruptible power supply.

In yet another preferred embodiment, it is highly preferred that the apparatus includes a slide plate which is slidably secured to the carriage and has two end sections. The slide plate includes a cam slot parallel to the direction of the door opening and closing movement and spanning the slide plate between the two end sections. Preferably, the cam slot has a slot end in each of the end sections. The slot ends each include (a) an end portion positioned below the spanning portion of the cam slot and (b) a ramp portion connecting each end portion with its corresponding ramp portion, such that the cam slot is a continuous slot between the two end portions. The slide plate also includes at least one limit slot parallel to the cam slot, each limit slot having a lock-limit end at each end of the limit slot and having a length at least as long as the length of the end portion plus the horizontal length of the ramp portion.

In this embodiment, it is highly preferred that a vertical lock bar is slidably secured to the frame and includes an upper end, a lower end and a cam follower secured to the upper end of the lock bar and configured to engage the cam slot. Further, the sliding door apparatus includes a limit pin for each of the limit slots, and the limit pins are secured with respect to the door and configured to engage its limit slot. The sliding door apparatus also has a lower-locked-open notch and a lower-locked-closed notch, both notches being fixed with respect to the frame and configured such that the lower-locked-open notch receives the lower end of the lock bar when the door is in a locked-open position and the lower-locked-closed notch receives the lower end of the lock bar when the door is in a locked-closed position.

It is also highly preferred that an upper-locked-open notch and an upper-locked-closed notch are both fixed with respect to the frame and that these notches are configured such that the upper-locked-open notch receives the upper end of the lock bar when the door is in a locked-open position and the upper-locked-closed notch receives the upper end of the lock bar when the door is in a locked-closed position.

Preferably, the frame includes a receiver assembly. The receiver assembly includes (a) a receiver strip configured to receive a vertical forward edge of the door when the door is in a closed position, (b) a power-source chamber to hold the power source, and (c) a key switch to enable a user to operate the door with a key.

The sliding door apparatus of this invention may be used in a wall of a secure facility such as a prison or other type of correctional facility or a military facility. In facilities of this type in which security is a major function, the doors need to be able to be opened under certain emergency situations.

The term "continuously-closed" as used herein refers to an operational state of a door in which a door is unlocked and when not held open, the door will close and remain closed until opened manually.

The term "continuously-closed signal" as used herein refers to a control signal which is used to set the state of a door to operate in a continuously-closed manner. For example, a continuously-closed signal could be sent to a sliding door apparatus as part of response to a fire alarm.

The term "controller" as used herein refers to any of a number of types of apparatus which are capable of providing actuation signals based on the position of objects and designed-in logic functions. These devices may be but are not limited to devices which are electrical, electronic or pneumatic. Such control devices and systems are well known in the art.

The term "cylinder having a piston" as used herein refers to hydraulic or pneumatic apparatus which may be a single-stage device or a multi-stage device.

BRIEF DESCRIPTION OF THE DRAWINGS

FIG. 9A includes a legend for several embodiments of controllers of the sliding door apparatus of FIGS. 1, 7, 10, 13 and 15, defining the various elements of the controller.

FIG. 9B provides definitions of the symbols used in the schematic of FIGS. 8A and 8B.

DETAILED DESCRIPTION OF PREFERRED EMBODIMENTS

Figure 1:
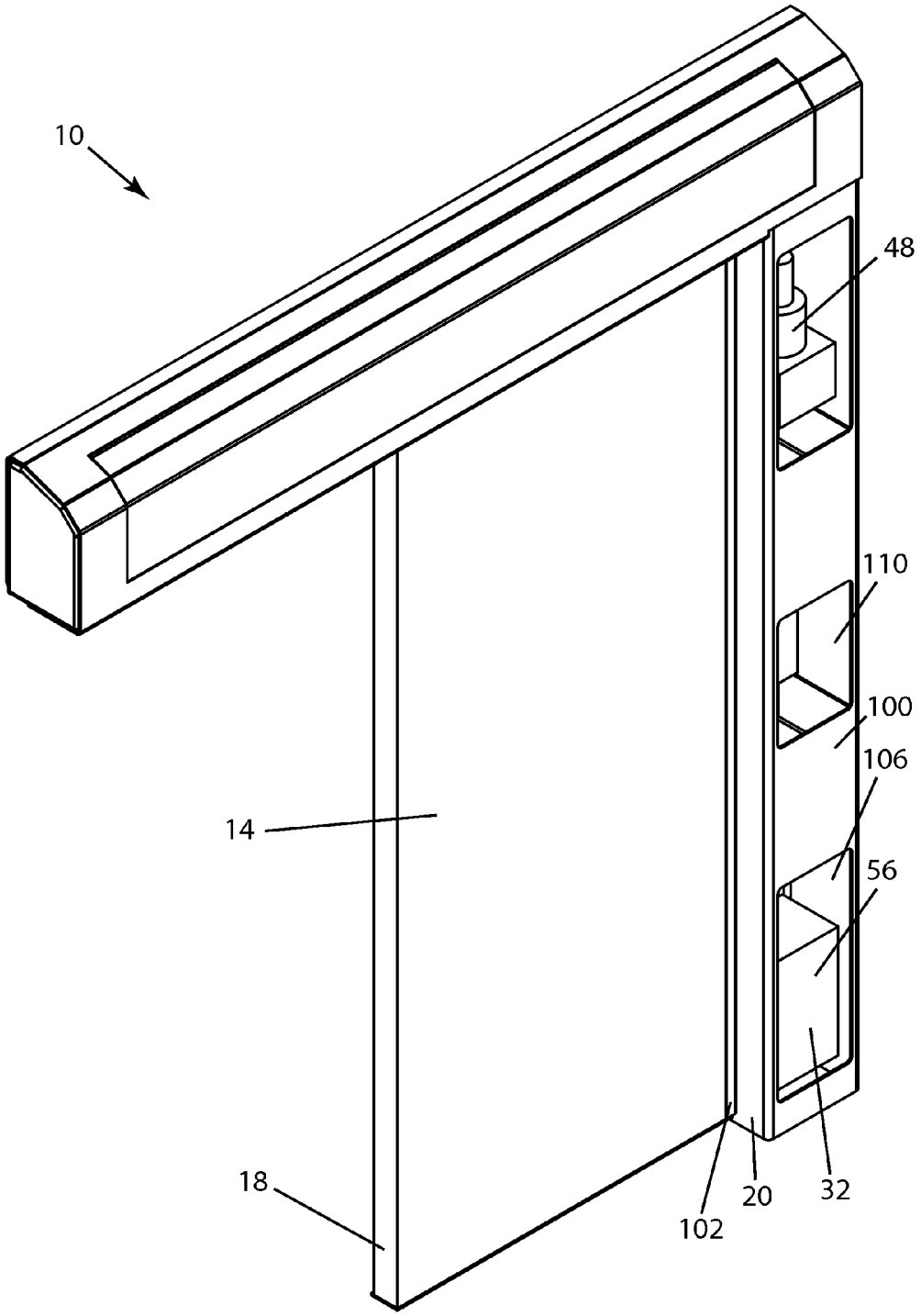
FIG. 1 is a perspective drawing of the sliding door apparatus of this invention.
Figure 2:
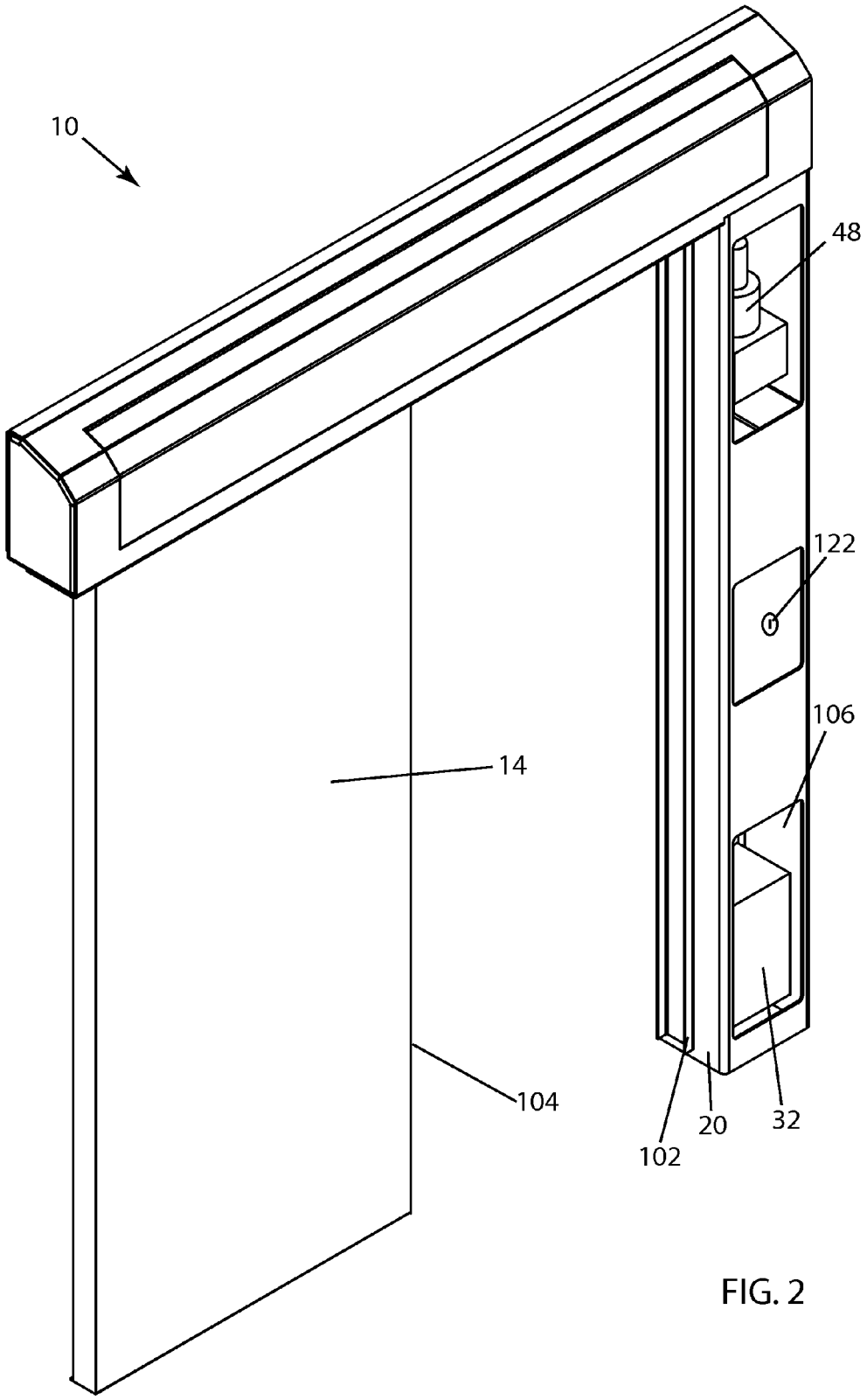
FIG. 2 is a perspective drawing of the sliding door apparatus of FIG. 1 with the door in an open position.
Figure 3:
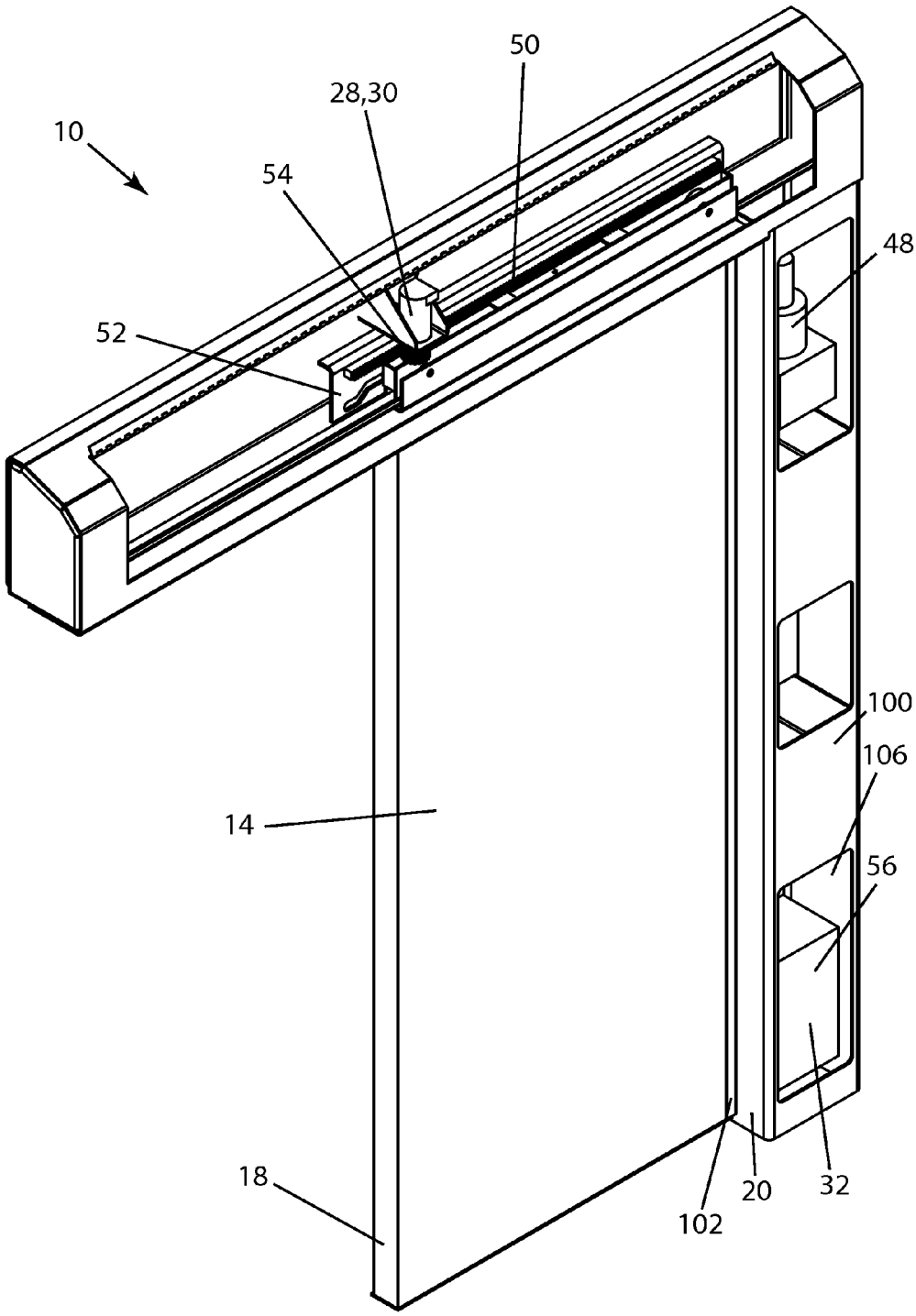
FIG. 3 is a perspective drawing of the sliding door apparatus of FIG. 1 with a cover removed to showed part of the mechanism.

FIGS. 1-6 illustrate a sliding door apparatus 10 for closing and opening a barrier (such as a door 14) in a wall (not shown). FIGS. 1 and 3 illustrate sliding door 14 in a closed position, and FIG. 2 illustrates door 14 in an open position.

As shown in FIGS. 1-6, sliding door apparatus 10 includes sliding door 14 having a top edge 16 and a bottom edge 18, a door frame 20 having a track 22 adjacent to top edge 16 of door 14. A carriage 24 is secured to top edge 16 of door 14 and has track-engaging rollers 26 and a drive mechanism 28 for opening and closing movement of door 14 as seen in FIGS. 1-6.

Figure 4:
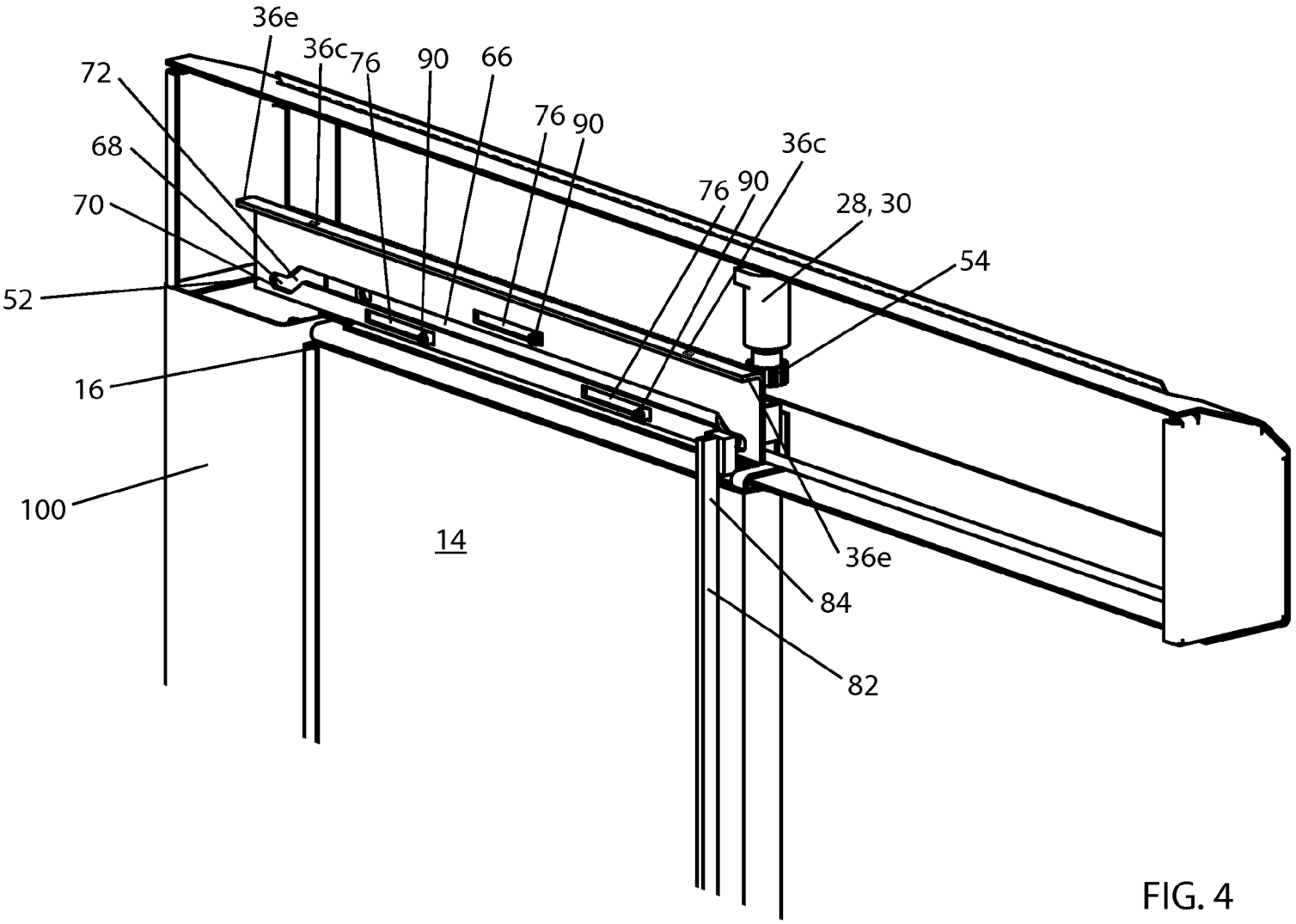
FIG. 4 is a partial perspective drawing of the sliding door apparatus of FIG. 1 with a back cover removed to showed part of the mechanism.
Figure 5:
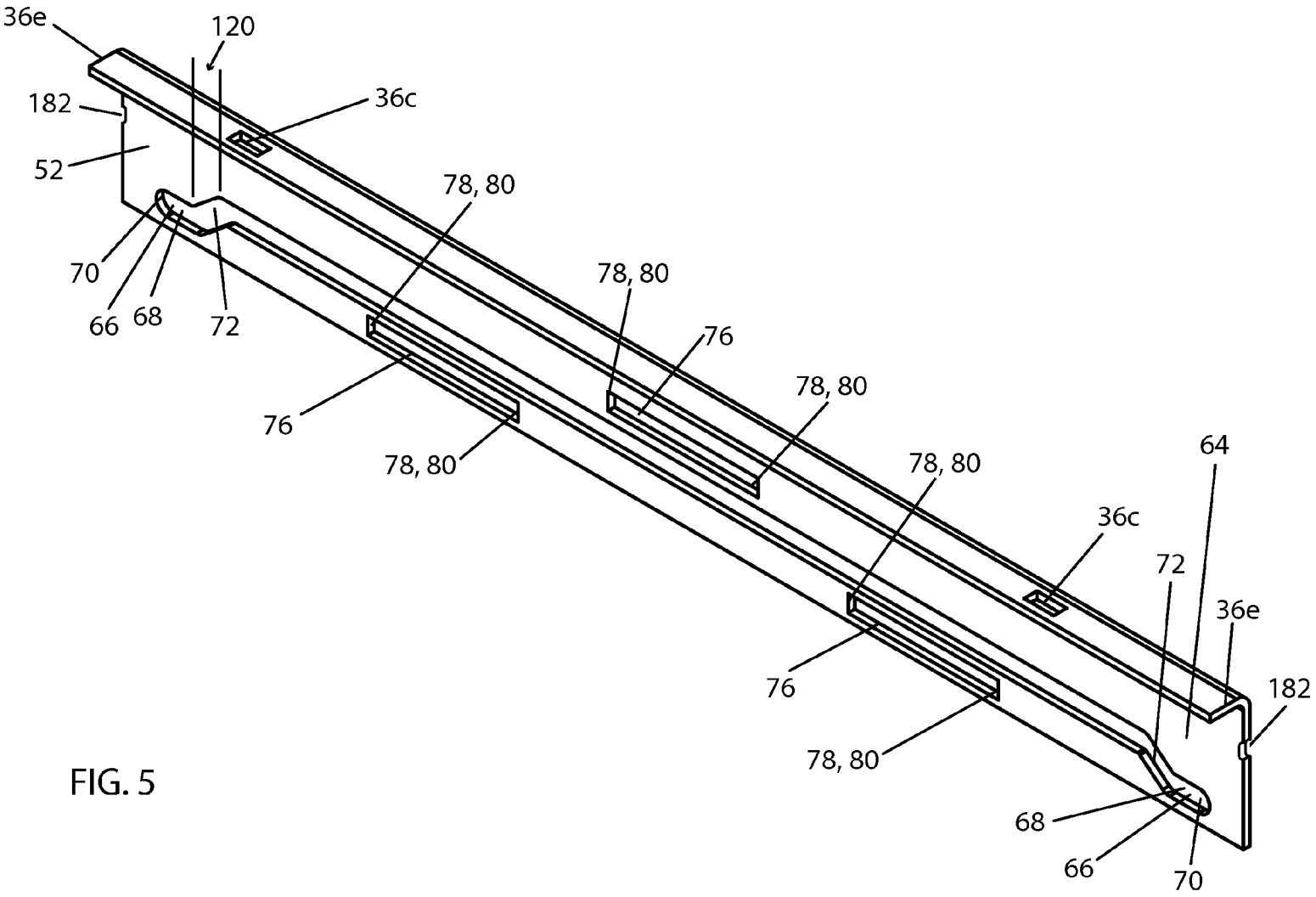
FIG. 5 is a perspective drawing of a slide plate of the sliding door apparatus of FIG. 1 with a cover removed to showed part of the mechanism.

As illustrated in FIGS. 3-4, drive mechanism 28 preferably includes a bi-directional effector 30 secured with respect to frame 20 and driving door 14. Along with bi-directional effector 30, a power-storing power source 32 and a controller 34 (not shown in FIGS. 1-6) are configured to enable door 14 to be continuously closed but not locked when a continuously-closed signal is received by controller 34. Controller 34 includes a plurality of limit sensors 36 which detect a plurality of door positions as seen in FIGS. 4 and 5 as well as schematically in FIGS. 7, 10, 11 and 13. Limit sensors may be mechanical switches as shown in the embodiments of controller 34, but also may be other devices such as Hall effect sensors which can provide similar signals. Limit sensors 36 in this embodiment each have a roller 36*r* which contacts slide plate 52. (Only FIG. 7 indicates reference numbers for limit sensors 36 and rollers 36*r*; such reference numbers also apply to FIGS. 10, 11, 13 and 14.)

FIG. 5 illustrates more detail of an embodiment of slide plate 52. Slide plate 52 includes two switch actuation ends 36*e* and two switch actuation cutouts 36*c*, all of which actuate sensors 36 (switches in this embodiment) as slide plate 52 moves past the rollers 36*r* of switches 36. Limit sensors 36 are mounted in sliding door apparatus 10 to be actuated at the desired locations along the path of movement of door 14. (See FIG. 6; not shown in FIGS. 3 and 4.)

Figure 6:
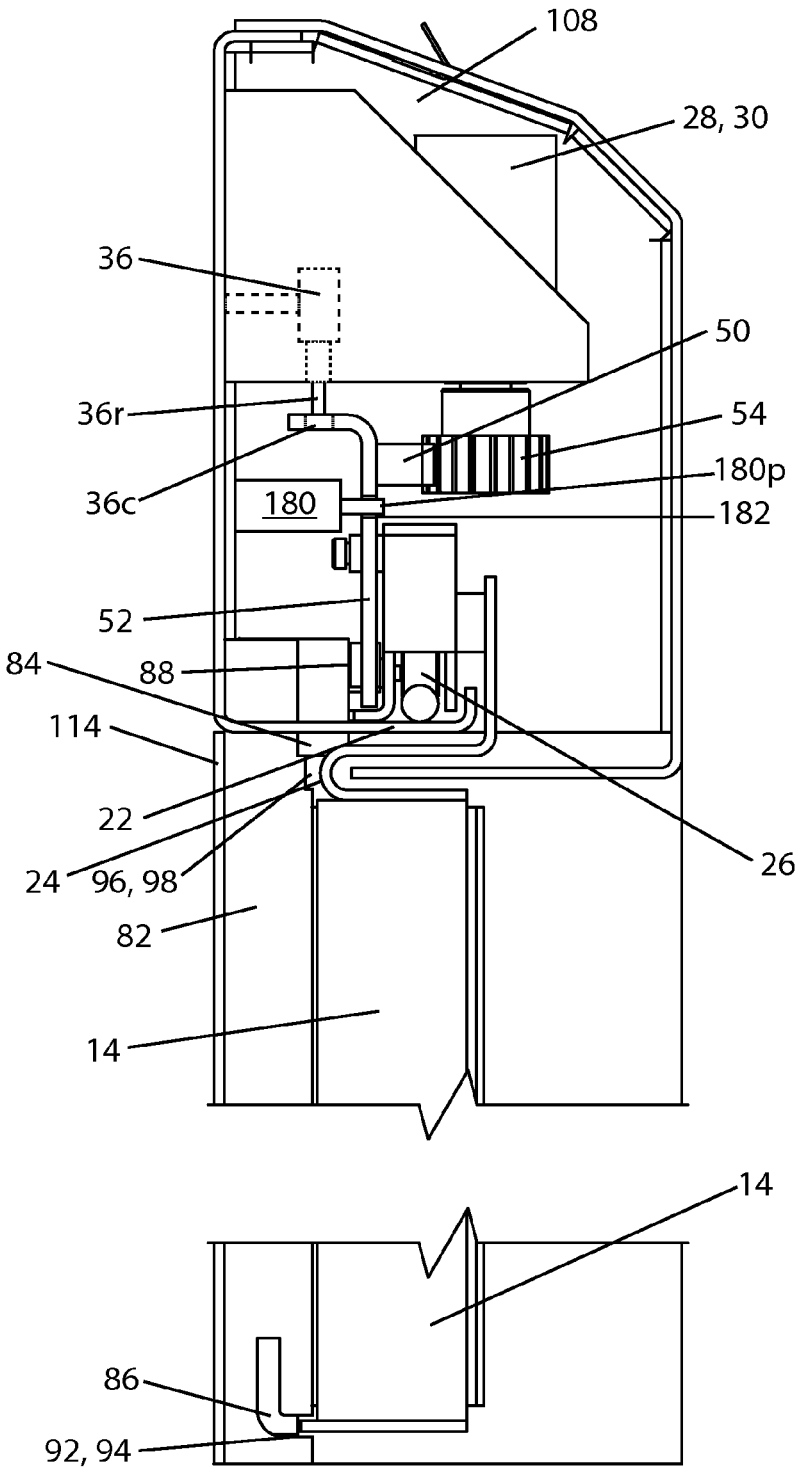
FIG. 6 is an end view of the mechanism of the sliding door apparatus of FIG. 1.

FIGS. 7, 10, 11, 13 and 14 illustrate that bi-directional effector 30 can have various embodiments such as a hydraulic motor 38, a hydraulic cylinder 40, a pneumatic motor 42, a pneumatic cylinder 44, or an electric motor 190. In one embodiment, as seen in FIGS. 1-6, bi-directional effector 30 is a hydraulic motor 38 and includes an electrically-driven hydraulic pump 48 secured with respect to frame 20. FIGS. 3 and 6 also illustrate that a rack 50 is secured with respect to a slide plate 52, and a pinion 54 driven by hydraulic motor 38 engages rack 50. In such embodiments, power-storing power source 32 is an electrical uninterruptible power supply 56 (UPS) as shown in FIGS. 1-3.

In another embodiment, bi-directional effector 30 is hydraulic cylinder 40 having a piston 58*h* and electrically-driven hydraulic pump 48 secured with respect to frame 20. Piston 58*h* is secured with respect to slide plate 52, and power-storing power source 32 is electrical uninterruptible power supply 56.

In yet another embodiment, bi-directional effector 30 is pneumatic motor 42 and includes a pneumatic connection 62 to a compressed air source 60. Pneumatic connection 62 is secured to frame 20. Rack 50 is secured to slide plate 52 and pinion 54 is driven by pneumatic motor 42 and engages rack 50.

Figure 13:
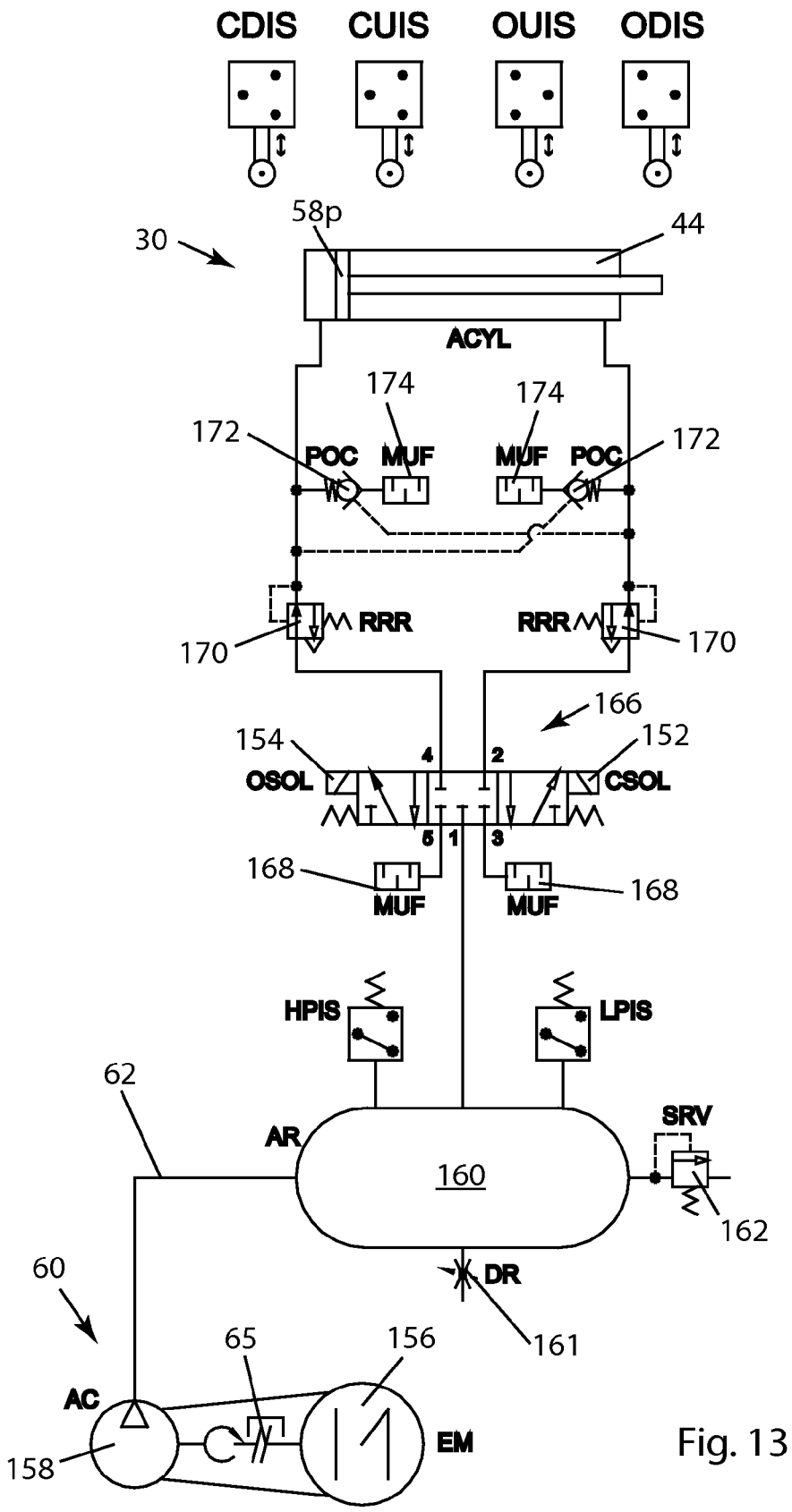
FIG. 13 is a pneumatic circuit schematic diagram for a pneumatic-cylinder-driven embodiment of the sliding door apparatus of FIG. 1.

In another embodiment, as shown in FIG. 13, bi-directional effector 30 is pneumatic cylinder 44 with a piston 58*p* and includes pneumatic connection 62 to compressed air source 60 as seen in FIG. 13. Pneumatic connection 62 is secured to frame 20 and piston 58*p* is secured to slide plate 52.

In other embodiments, bi-directional effector 30 may be an electric motor driving rack 50 secured to slide plate 52 using a ballscrew 192 or other mechanical element(s) to transfer rotary motion to linear motion. Numerous other effector/drive-element combinations may be adapted to drive door 14 to achieve the desired movement of the inventive sliding door apparatus.

As seen in FIGS. 3-6, slide plate 52 is slidably secured to carriage 24 and has two end sections 64. FIG. 4 shows that slide plate 52 includes a cam slot 66 parallel to the direction of the door opening and closing movement and spanning slide plate 52 between two end sections 64.

FIG. 5 illustrates in detail that cam slot 66 has a slot end 68 in each of end sections 64. Slot ends 68 each include an end portion 70 positioned below a spanning portion 74 of cam slot 66. Each slot end 68 also has a ramp portion 72 connecting each end portion 70 with its corresponding ramp portion 72 such that cam slot 66 is a continuous slot between the two end portions 70. Slide plate 52 includes three limit slots 76 parallel to cam slot 66. Each limit slot 76 has a lock-limit end 78 at each end 80 of limit slot 76 and has a length at least as long as the length of end portions 70 plus the horizontal length 120 of ramp portion 72 as seen in FIG. 5.

During normal operation, the slot ends 68 allow slide plate 52 to move beyond carriage 24. This deadlocks door 14 in either the fully-open or fully-closed positions. In emergency operation, deadlock prevention latching solenoids 180 (labeled DPS in FIG. 8C), each located to prevent slide plate 52 from moving beyond carriage 24, one at each end of slide plate movement. Solenoids 180 having plungers 180*p* (see FIG. 6) are latching solenoids which change state (plungers 180*p* out or in) with a pulse of current (positive or negative polarity). This action (plungers 180*p* out) prevents slide plate 52 (and door 14) from moving to a deadlocked position from the inertia during manually door 14 movement. Two stops 182 (see FIG. 5), one at each end of slide plate 52, may be used to receive solenoid 180 plungers 180*p*.

As shown in FIGS. 4 and 6, sliding door apparatus includes a vertical lock bar 82 which is slidably secured to frame 50 and includes an upper end 84, a lower end 86 and a cam follower 88 secured to upper end 84 of lock bar 82 and configured to engage cam slot 66.

Sliding door apparatus 10 has a lower-locked-open notch 92 and a lower-locked-closed notch 94. Both notches 92, 94 are fixed with respect to frame 20 and configured such that lower-locked-open notch 92 receives the lower end 86 of lock bar 82 when door 14 is in a locked-open position and lower-locked-closed notch 94 receives the lower end 86 of lock bar 82 when door 14 is in a locked-closed position as seen in FIG. 6. Vertical lock bar 82 travels in a sheath 114 mounted on frame 20. Vertical lock bar 82 is preferably made of solid bar stock.

Sliding door apparatus 10 also includes an upper-locked-open notch 96 and an upper-locked-closed notch 98 both of which are fixed to frame 20 as illustrated in FIG. 6. Upper-locked-open notch 96 and upper-locked-closed notch 98 are configured such that upper-locked-open notch 96 receives upper end 84 of lock bar 82 when door 14 is in a locked-open position and upper-locked-closed notch 98 receives upper end 84 of lock bar 82 when door 14 is in a locked-closed position as seen in FIG. 6.

Sliding door apparatus 10 includes a limit pin 90 for each limit slot 76 as seen best in FIG. 4. Limit pins 90 are secured with respect to door 14 and configured to engage its corresponding limit slot 76.

Frame 20 includes a receiver assembly 100. Receiver assembly 100 includes receiver strip 102 configured to receive a vertical forward edge 104 of door 14 when door 14 is in a closed position as seen in FIGS. 1-3. FIGS. 1-3 further illustrate that receiver assembly 100 also includes power-source chamber 106 to hold electrical uninterruptible power supply 56 and a key switch chamber 110 to enable a user to operate door 14 manually with a key switch 122 (see FIG. 2).

Slidable door 14 with vertical lock bar 82 function as a security barrier which can be one of multiple security barriers in a criminal detention or similar type facility. In normal operation, its primary purpose is to open or close door 14 to a selectable desired position by a command signal from an external command source. Controller 34 receives the desired command and controls the movement of door 14 in the proper direction until a desired, predetermined position is achieved. Upon door 14 reaching the desired, predetermined position, controller 34 controls door 14 movement to stop door 14 in place. Controller 34 outputs the position of door 14 using a number of limit sensors 36. Limit sensors 36 indicate when door 14 is at one predetermined position for each limit sensor 36. This ensures other controllers or devices which may be connected to controller 34 can know when door 14 is in or out of position.

The preferred embodiment utilizes four primary door positions. These four positions are "closed and deadlocked," "closed and unlocked," "open and unlocked," and "open and deadlocked." Sliding door apparatus 10, is configured such that when door 14 is either in an open or closed deadlocked position, door 14 cannot be moved by normal human intervening forces such as pushing, pulling, prying, or other similar physical activities. Further, sliding door apparatus 10 is configured such that when door 14 is in either the open or closed unlocked position door 14 can be moved by such normal human intervening forces.

The deadlocking mechanism, uninterruptible power supply 56, controller 34, and mechanical actuation system (e.g., bi-directional effector 30, rack 50, etc.) will be preferably protected from normal human interference for the purpose of security.

In the event of a fire or similar emergency, it is desirable that door 14 remain closed but unlocked, thereby allowing a manual external force to open door 14. In such a situation, a dedicated emergency input is provided to move door 14 to a closed and unlocked position. Controller 34 will retain this desired emergency position command and repeatedly move door 14 back into a closed position after each time door 14 is moved to an open position manually.

Figure 7:
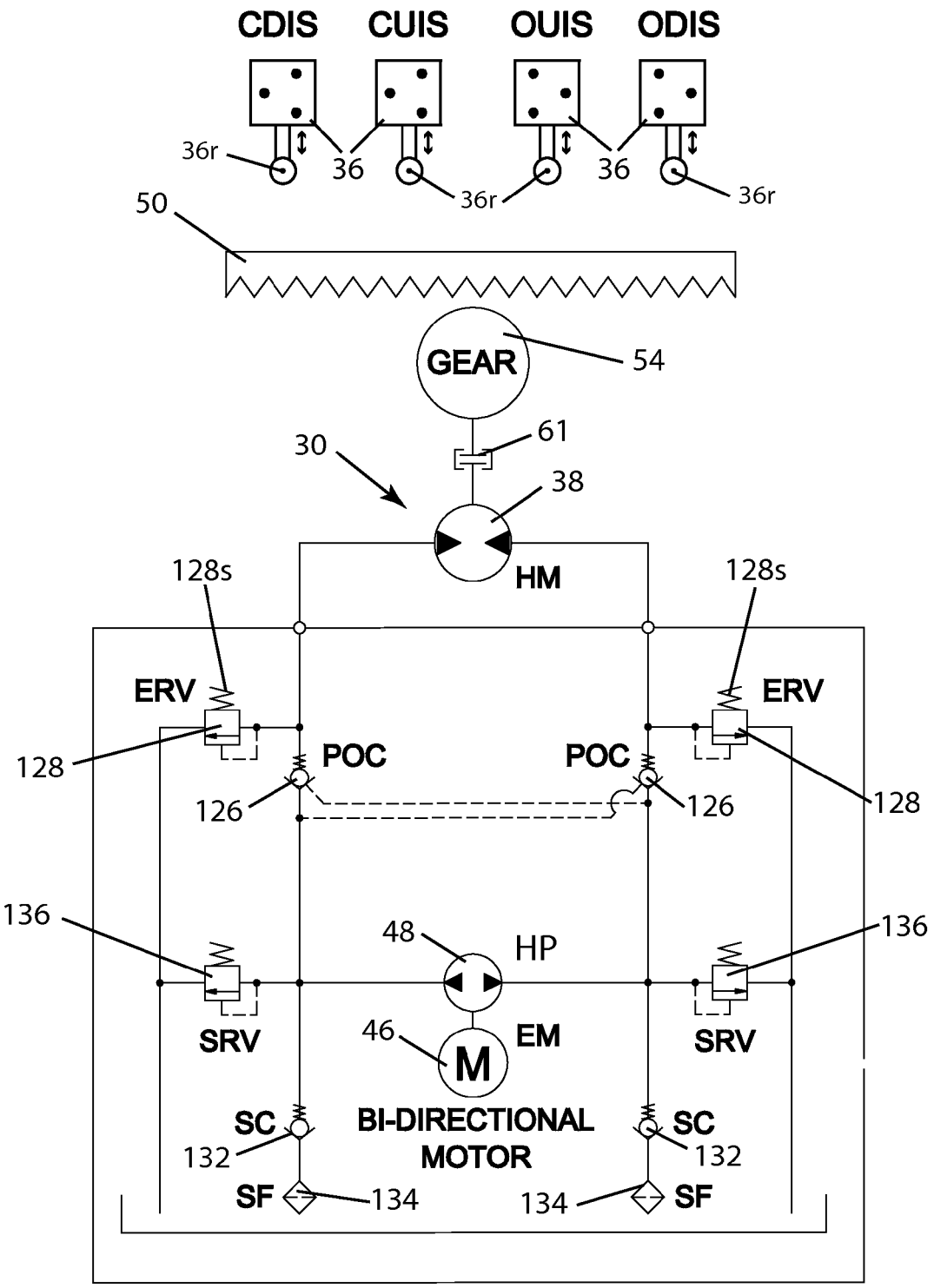
FIG. 7 is a hydraulic circuit schematic diagram for a hydraulic-motor-driven embodiment of the sliding door apparatus of FIG. 1.

FIG. 7 shows a hydraulic circuit schematic of the hydraulic system of an embodiment of sliding door apparatus 10 which uses hydraulic motor 38 with a flexible coupling 61 and electrically-powered bi-directional pump 48 to drive rack 50 with pinion 54. Rack 50 is attached for lateral movement to slide bar 52. Controller 34 enables electric motor 46 to drive hydraulic pump 48 in either direction, which in turn drives hydraulic motor 38 one way or the other to open or close door 14. When the hydraulic power is shut off (hydraulic pump 48 is off), a pair of pilot-operated check valves (POC) 126 lock hydraulic fluid in the hydraulic chambers and plumbing connections on either side of hydraulic motor 38, thereby keeping door 14 in place when door 14 is not in a deadlocked position. When in deadlock, it is not possible to open door 14 unless lock bar 82 is first released by normal actuation.

To allow passage through door 14 when not deadlocked, a pair of emergency relief valves (ERV; one for each direction) 128*s* allow hydraulic fluid to flow to a reservoir 130 at a controlled pressure corresponding to the desired maximum force required to push door 14 open. This pressure and corresponding force are set by the valve spring 128*s* in each relief valve 128. On the opposite side of an opened ERV relief valve 128, the pilot-operated check valves 126 and a suction check valve (SC) 132 allow hydraulic fluid to be pulled from reservoir 130 into the hydraulic system to avoid cavitation. SC valves 132 are present to maintain hydraulic fluid in the lines, and suction filters (SF) 134 are used to help maintain fluid cleanliness. Safety relief valves (SRV) 136 are also used to ensure the hydraulic system is not over-pressurized.

Figure 8A:
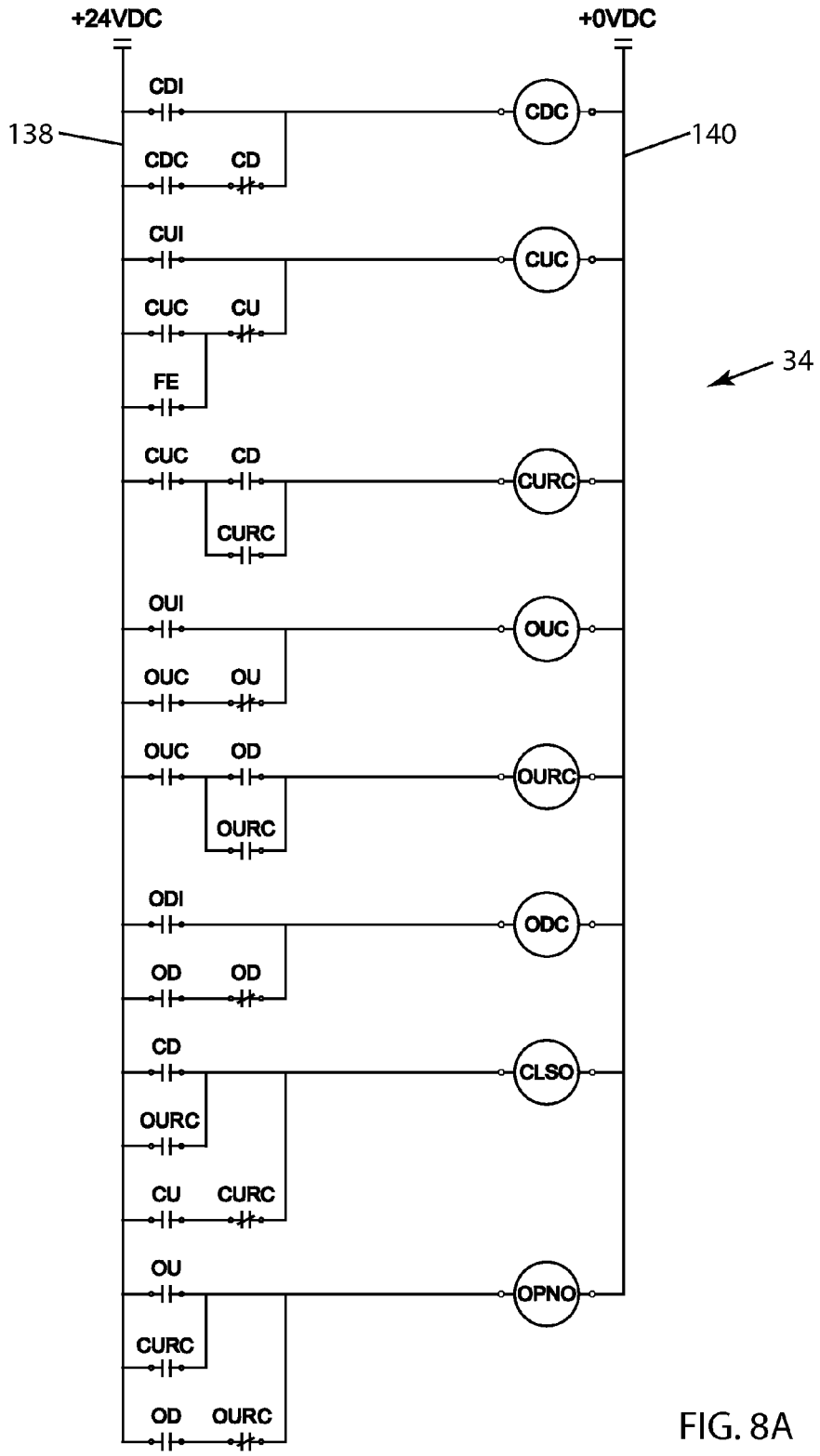
FIGS. 8A, 8B and 8C are together a logic diagram of a controller to control the sliding door apparatus of FIGS. 1 and 7 with a hydraulic bi-directional effector.
Figure 8B:
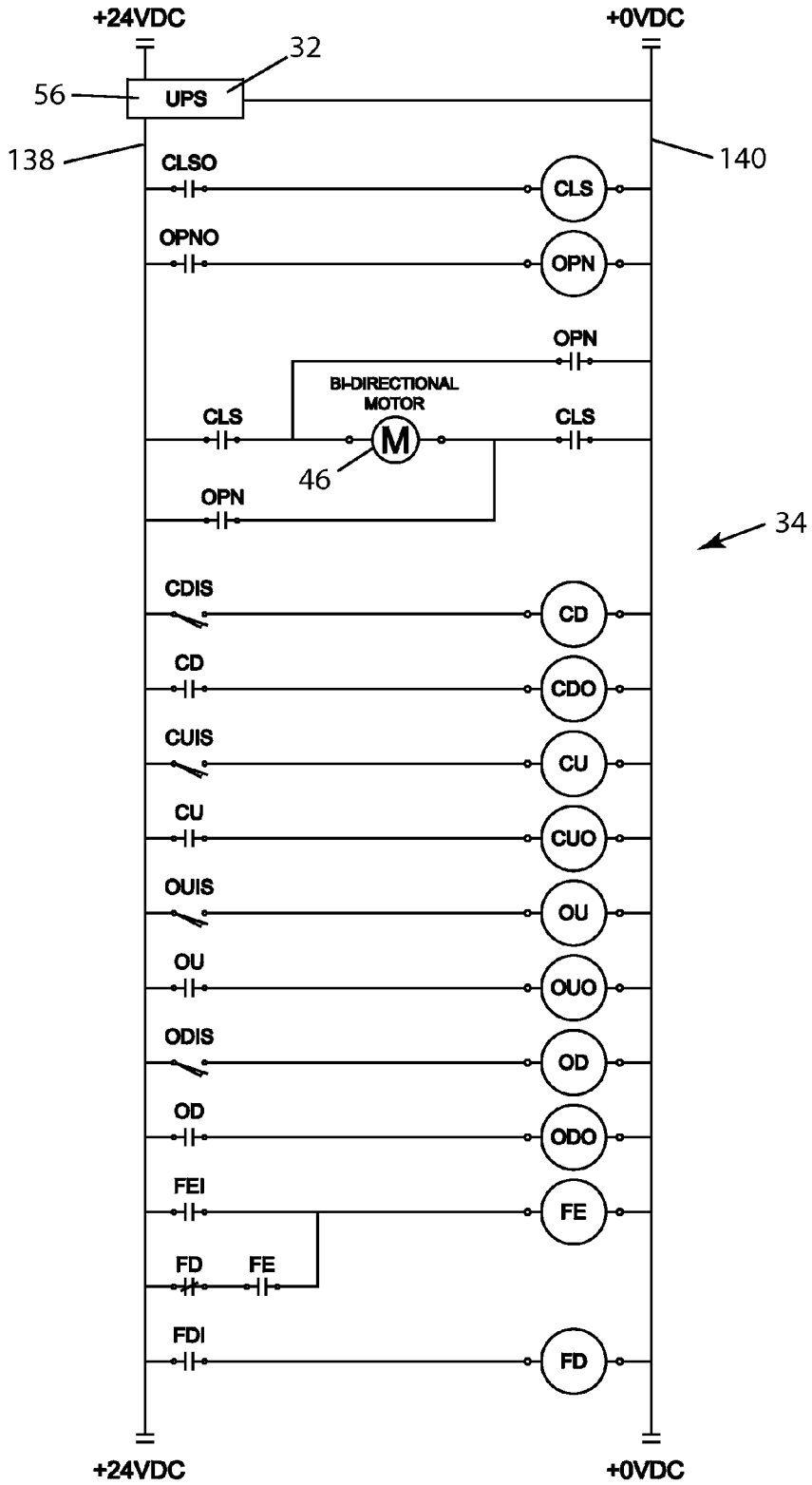
Figure 8C:
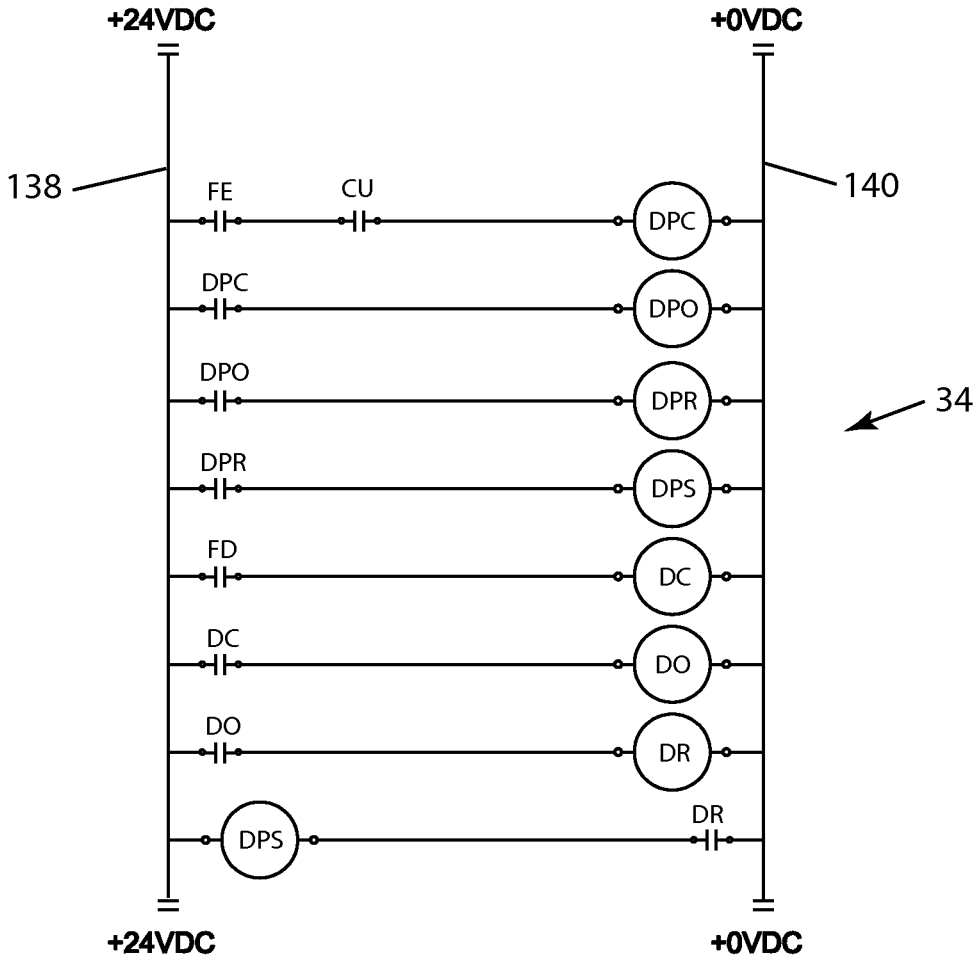

FIGS. 8A, 8B and 8C together are a logic diagram of controller 34 for controlling the embodiment of sliding door apparatus 10 of FIGS. 1 and 7 which is driven by hydraulic motor 38. The control logic of controller 34 in FIGS. 8A-8C may be programmed using devices such as an IDEC Programmable Relay FL1E-B12RCA or similar devices to move door 14 to the proper position for each command.

The control logic schematic of FIGS. 8A-8C is arranged having a +24 VDC (volts DC) rail 138 and a +0 VDC rail 140 with lines or rungs in the schematic spanning between these two rails. These rails are shown as having voltages associated with them, but it should be noted that FIGS. 8A-8C (and FIGS. 12A-12D) are not electrical circuits but logic schematics having some circuit characteristics to represent the control logic in controller 34. When the a line or rung spanning between rails 138, 140 is closed, such closing causes certain actions to occur within controller 34. FIG. 9A is a legend for controller 34 of FIGS. 8A-8C (and FIGS. 12A-12D), defining each element of controller 34. FIG. 9B provides definitions of the various symbols used in FIGS. 8A-8C (and FIGS. 12A-12D). It should be noted that the terminology of relays and relay contacts is used in the explanation of the control logic of FIGS. 8A-8C. However, as mentioned above, the control logic preformed by controller 34 may be realized in numerous other ways, including but not limited to programmable logic arrays, micro-controllers and other computer-based devices.

Other inputs are received in the form of commands from an external system. Controller 34 (and controllers 150 and 198 for later embodiments) is configured to interface with a building controller, individual operating station, a combination of both, or other position command devices (all such devices not shown). Such systems are well-known to those skilled in the field of electrical controls. Commands received from such an external system are indicated in FIG. 8A and FIG. 9A as FEI, FDI, CDI, CUI, OUI and ODI.

FIG. 7 includes input sensors 36 (limit switches) CDIS, CUIS, OUIS and ODIS. The eight lines or rungs in FIG. 8B which near the right rail of the ladder diagram span from internal relay CD to output ODO receive limit switch inputs from the four predetermined stopping points for door 14, one stopping point for each of the four switches, and then transmit the positions through outputs to other control devices. Each position limit switch CDIS, CUIS, OUIS, and ODIS is a normally-open device that closes when door 14 reaches its corresponding predetermined position. The switches are placed in sliding door apparatus 10 so that only one device can indicate (is closed) at a time.

For example, when CDIS is closed (see FIG. 8B), internal relay CD is set which sets a normally-open contact CD to energize output relay CDO. (As in this example, note that relay CD has normally-open contacts CD and normally-closed contacts CD, differentiated by the symbols used in each instance.) The remaining logic inside controller 34 uses these contacts CD, CU, OU, and OD to know when door 14 is in one of the four positions, and outputs CDO, COU, OUO, and ODO to communicate this information to other devices.

In FIG. 8B, below the four pairs of input switches and relays, are two lines or rungs of logic configured to accept a momentary emergency command input FEI from an external source and retain the emergency command for emergency operation. Input command FEI sets internal relay FE which is then latched closed through the normally-closed contact FD and normally-open contact FE. As long as internal relay FD is not set by receipt of an FDI input command, relay FE will remain latched to retain the emergency command.

Position commands from an external source are handled in a similar way with a latch to retain the commanded position input until door 14 reaches a commanded predetermined position. For example, when a "closed and deadlocked" command input CDI is received (see the top line or rung in FIG. 8A), it sets internal relay CDC and latches it through normally-open CDC and normally-closed CD contacts. Until or unless the position switch corresponding to the commanded position is reached (i.e. when input switch CDIS is closed), position command relay CDC will remain latched. This logic is replicated for the other three position inputs CUI, OUI, and ODI.

In FIG. 8A, the rung with relay CUC has an additional normally-open contact in parallel with the CUC latch, configuring sliding door apparatus 10 to have a door 14 default position for emergencies. Relay FE will continuously keep the "closed and unlocked" position command (relay FE will remain latched) as long as the CUIS switch is not indicating that door 14 has reached its predetermined "closed and unlocked" position. This serves to continuously close door 14 whenever it is forced open unless or until an FD emergency disable command is received or there is no longer power available from electrical uninterruptable power supply 56.

For the two "unlocked" positions, door 14 must be able travel in either direction to reach the desired predetermined position depending on the actual position of door 14 when the command with no deadlock is received. Controller 34 has two relays that will reverse the directional command when appropriate. When the "closed and unlocked" command relay CUC is latched, the third rung of FIG. 8A is configured to check if the barrier is in the CD position. This is accomplished by placing the normally-open contacts CD and CUC in series with each other to set the internal relay CURC and latch it until door 14 reaches the predetermined "closed and unlocked" position. Unlatching CUC will automatically also unlatch relay CURC. A similar logic arrangement is also used for latching relay OURC which reverses the direction to reach the "open and unlocked" position when door 14 is in the OD position.

All of the position commands generated (CDC, CUC, CURC, OUC, OURC, and ODC) are subsequently used to control a pair of outputs CLSO and OPNO that energize power relays CLS and OPN which are configured to power electric motor 46 that drives hydraulic pump 48. Which of these power relays that is energized determines which direction electric motor 46 will turn and thus the direction (open or close) which door 14 will move. The CDC and OURC commands both energize closing power relay CLS. The CUC command also energizes power relay CLS but only when the normally-closed contact on relay CURC is closed. The OUC and CURC commands both energize the opening power relay OPN. The ODC command also energizes power relay OPN but only when the normally-closed contact on relay OURC is closed.

FIG. 8C illustrates logic within controller 34 for controlling two latching solenoids 180 (DPS) to prevent door 14 from being deadlocked during a commanded emergency situation. When controller 34 is in a fire-enabled mode and door 14 has moved to its commanded "closed and unlocked" position, a one-shot timer internal relay DPC is set for a predetermined period of time to allow an output DPO to energize a wired relay DPR. Relay DPR energizes each latching solenoid 180 to extend plungers 180*p*, thereby preventing deadlock. Similar logic is provided, using a one-shot timer internal relay DC, output DO, and wired relay DR, to retract plungers 180*p* of solenoids 180 when deadlock is desired. Note that latching solenoids 180 (DPS) are shown only once but are in fact both wired to the same contacts because their operation is identical. The notation in FIG. 8C (and FIG. 12D) for the rung containing contacts DR and latching solenoids 180 (DPS) is shown in reverse orientation to all the other rungs to indicate reverse polarity to drive latching solenoids 180 (DPS).

Figure 10:
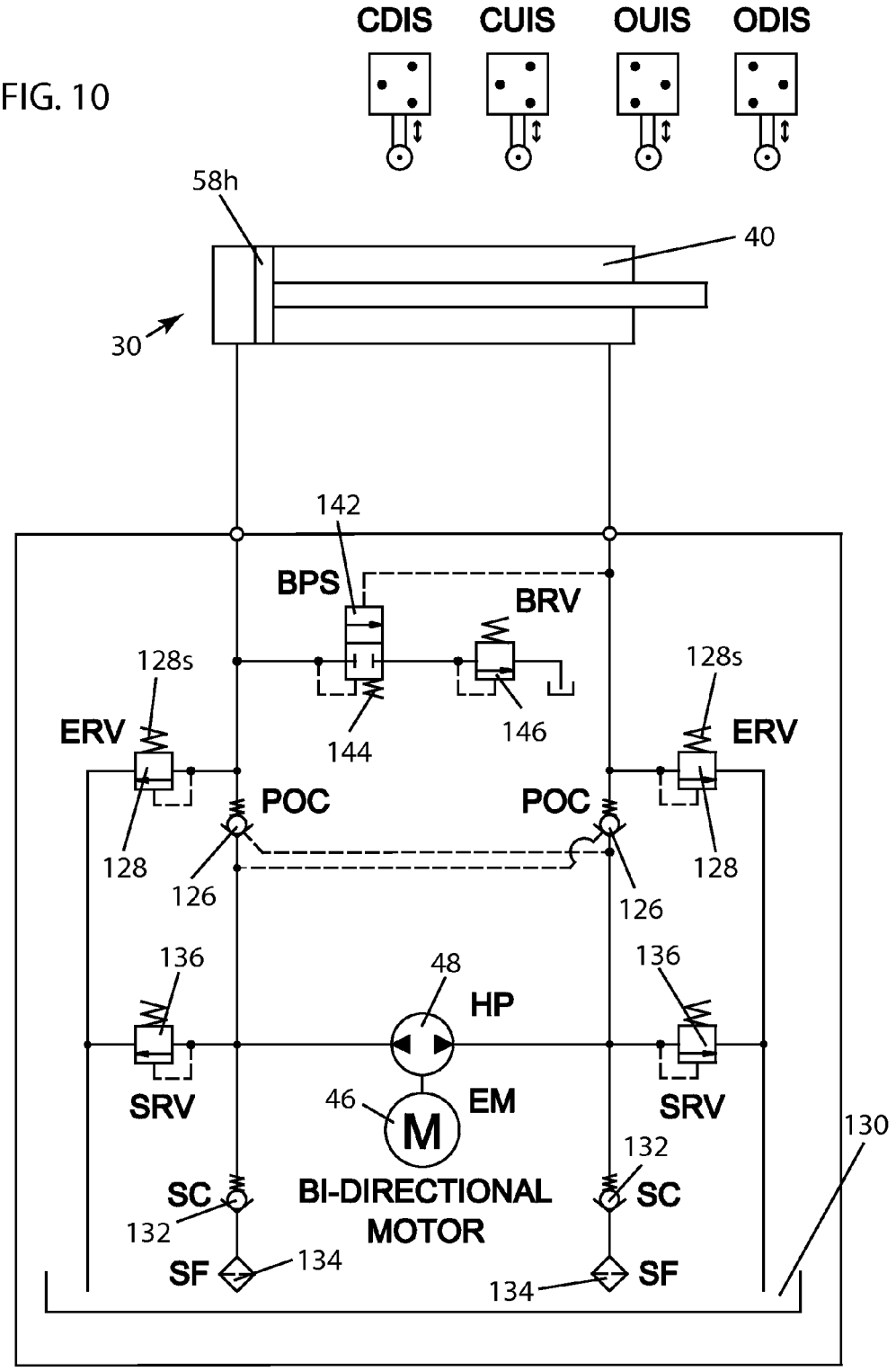
FIG. 10 is a hydraulic circuit schematic diagram for a hydraulic-cylinder-driven embodiment of the sliding door apparatus of FIG. 1.

FIG. 10 is a hydraulic circuit schematic of the hydraulic system of an embodiment of sliding door apparatus 10 which uses hydraulic cylinder 40 and electrically-powered bi-directional pump 48 to drive slide bar 52. Controller 34 enables electric motor 46 to drive hydraulic pump 48 in either direction which in turn drives hydraulic cylinder 40 one way or the other to open and close door 14. The installation of cylinder 40 determines which way piston 58*h* must travel to open or close door 14; controller 34 of FIGS. 8A-8C can be configured to function in either manner by simply swapping the CLSO and OPNO outputs to the wired relays.

When motor 46 is powered to retract cylinder 40, the volume of hydraulic fluid returned from cylinder 40 is greater than the volume of hydraulic fluid used by hydraulic pump 48 due to the area difference of cylinder 40 (allowing for the shaft of piston 58*h*). For this reason, the hydraulic circuit is configured to return the extra fluid to reservoir 130 while still providing sufficient hydraulic fluid to the suction side of hydraulic pump 48. A normally-closed bypass spool valve 142 (BPS) is piloted open by fluid pressure against a spring 144 when cylinder 40 is being retracted under power. Opening spool valve 142 allows the hydraulic fluid returning from cylinder 40 to flow into reservoir 130 at a low pressure through a back-pressure relief valve 146 which is set low enough to limit energy losses in the system but high enough to ensure that the returning hydraulic fluid is first forced into the suction side of pump 48 to prevent cavitation. When cylinder 40 is extending, back-pressure relief valve 146 remains closed because the pilot pressure is not sufficient to open it.

When hydraulic power is shut off (pump 48 is off), a pair of pilot-operated check valves 126 lock fluid in both sides of cylinder 40, thereby keeping door 14 in place when not in a deadlocked position. When in the deadlocked position, it is not possible to force door 14 open unless lock bar 82 is first released.

Passage through door 14 when it is not deadlocked is enabled by a pair of emergency relief valves 128 (one for each direction) which allow hydraulic fluid to flow into reservoir 130 at a controlled pressure corresponding to the desired maximum force required to push door 14 open. This pressure and corresponding force are set by valve spring 128*s* in relief valve 128. On the opposite side of an opened relief valve 128, the pilot-operated check valve 126 and suction check valve 132 allow hydraulic fluid to be pulled into the system to avoid cavitation. The suction check valves 132 are present to maintain hydraulic fluid in the lines, and suction filters 134 are used to help maintain fluid cleanliness. Safety relief valves 136 are also used to ensure the system cannot become overpressurized.

Figure 11:
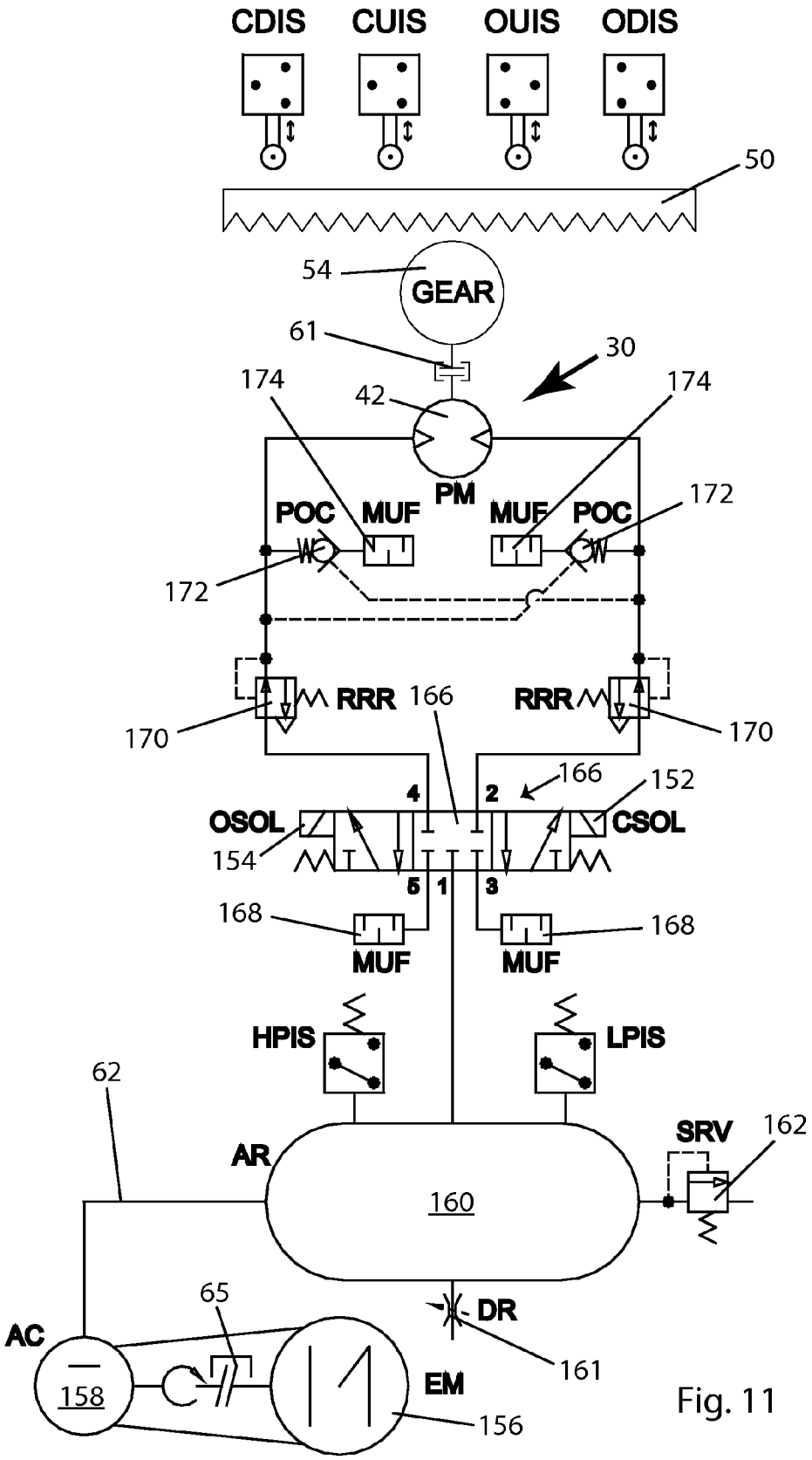
FIG. 11 is a pneumatic circuit schematic diagram for a pneumatic-motor-driven embodiment of the sliding door apparatus of FIG. 1.

FIG. 11 shows a pneumatic circuit schematic of the pneumatic system of an embodiment of sliding door apparatus 10 which uses pneumatic motor 42 and electrically-powered compressed air source 60 to drive rack 50 with pinion 54. Rack 50 is attached for lateral movement to slide bar 52. A controller 150 (see FIGS. 11-12D) enables compressed air to drive pneumatic motor 42 in either direction to open and close door 14. The control of a pneumatic system for opening and closing sliding door apparatus 10 is similar to the control of a hydraulic system for the same purpose. Therefore, the example controllers 34 (FIGS. 7-8C) and 150 have many elements and much structure in common. (Note that FIG. 9A is also the legend for elements of controller 150.)

Referring now to FIGS. 12A-12D, the internal position commands (CDC, CUC, CURC, OUC, OURC, and ODC) are used to control a pair of outputs (CLSO and OPNO) that energize power relays CLS and OPN. These relays energize pneumatic valve solenoid coils CSOL 152 and OSOL 154 to control the air flow to the pneumatic motor 42. This determines which direction motor 42 will spin and the direction of motion for door 14. The CDC and OURC commands both energize closing relay CLS. CUC also energizes CLS but only when the normally-closed contact on CURC is closed. The OUC and CURC commands both energize opening relay OPN. ODC also energizes OPN, but only when the normally-closed contact on OURC is closed.

There are also three internal relays (LP, HP and RUNC) that are used to control a compressor motor 156 and flexible coupling 65 driving compressor 158 in compressed air source 60 to supply compressed air to the pneumatic circuit of FIG. 11. A low-pressure input switch (LPIS) sets internal relay LP and a high-pressure input switch (HPIS) energizes internal relay HP. When air pressure is lower than the set point of LPIS, internal relay LP is set. When air pressure is lower that the set point of HPIS, internal relay HP is set. These two internal relays then control internal relay RUNC which subsequently controls output Compressor Relay Output (CMPO). CMPO energizes a relay RM to power motor 156 to compressor 158.

Because the set point of switch HPIS is higher than that of switch LPIS, internal relay HP is always set when air pressure is low enough to set internal relay LP. When this occurs, internal relay RUNC is set, output CMPO output goes high, and the relay RM turns motor 156 on. Normally-open contact RUNC is also latched across LP to hold RUNC until HP opens due to switch HPIS reaching set-point pressure. Switch HPIS is adjusted to the maximum desired air pressure in the system.

Controller 150 controls motor 156 to maintain the air pressure inside a compressed-air reservoir (tank 160 with drain 161) 158 between a low and high level set by input switches LPIS and HPIS. A pneumatic safety relief valve 162 (SRV) ensures that a malfunction in controller 150 cannot overpressurize tank 160. A manual drain valve 164 (DR) is also included to depressurize tank 160 for maintenance and to drain any water that collects inside tank 160 during normal operation.

A pneumatic solenoid valve 166 (VLV) controls which port of motor 42 is pressurized, thereby controlling the direction of motor 42 and door 14. Inlet port 1 of valve 166 is connected to tank 160, and ports 3 and 5 of valve 166 are both return ports connected to atmosphere through a pair of pneumatic mufflers 168 (MUF) that serve to reduce noise and block contamination from entering the valve 166 through ports 3 and 5. When valve 152 (CSOL) is energized, compressed air flows from inlet port 1 of valve 166 to port 2 of valve 166 and through a reducing relieving pressure regulator 170 (RRR) to an inlet port of motor 42. Regulator 170 serves to limit the air pressure delivered to motor 42 thus determining a maximum force on door 14. Regulator 170 also relieves air pressure to the atmosphere in the event of a force pushing door 14 in the reverse direction. Two regulators 170 are used, one for each direction of motor 42.

Also connected to port 2 of valve 166 through regulator 170 is a pilot-operated check valve 172 (POC) that provides two functions. First, check valve 172 opens up to allow return air from motor 42 to go directly to atmosphere through a muffler 174 (MUF) when door 14 is being open under power. A pilot line 176 is connected to the opposite side of motor 42 to control this function which is intended to bypass the pressure-relieving function of regulator 170. Second, check valve 172 allows air to be pulled into motor 42 when motor 42 is being driven by a manual force on door 14 in the opposite direction. Check valve 172, muffler 174 and pilot line 176 are repeated for the other side of motor 42, connected to port 4 of valve 166.

Figure 12A:
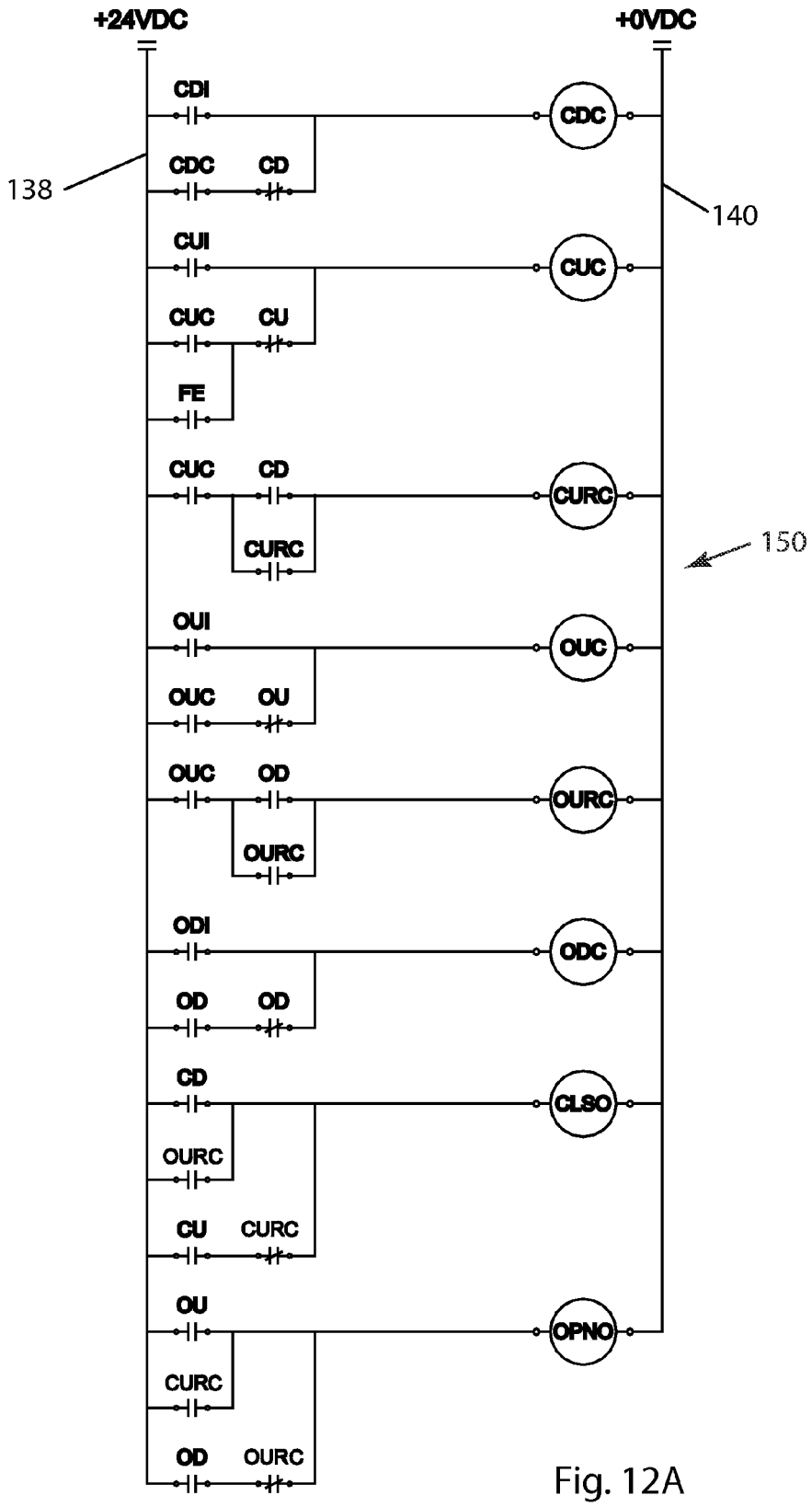
FIGS. 12A, 12B, 12C and 12D are together a logic diagram of a controller to control the sliding door apparatus of FIGS. 1 and 7 with a pneumatic bi-directional effector.
Figure 12B:
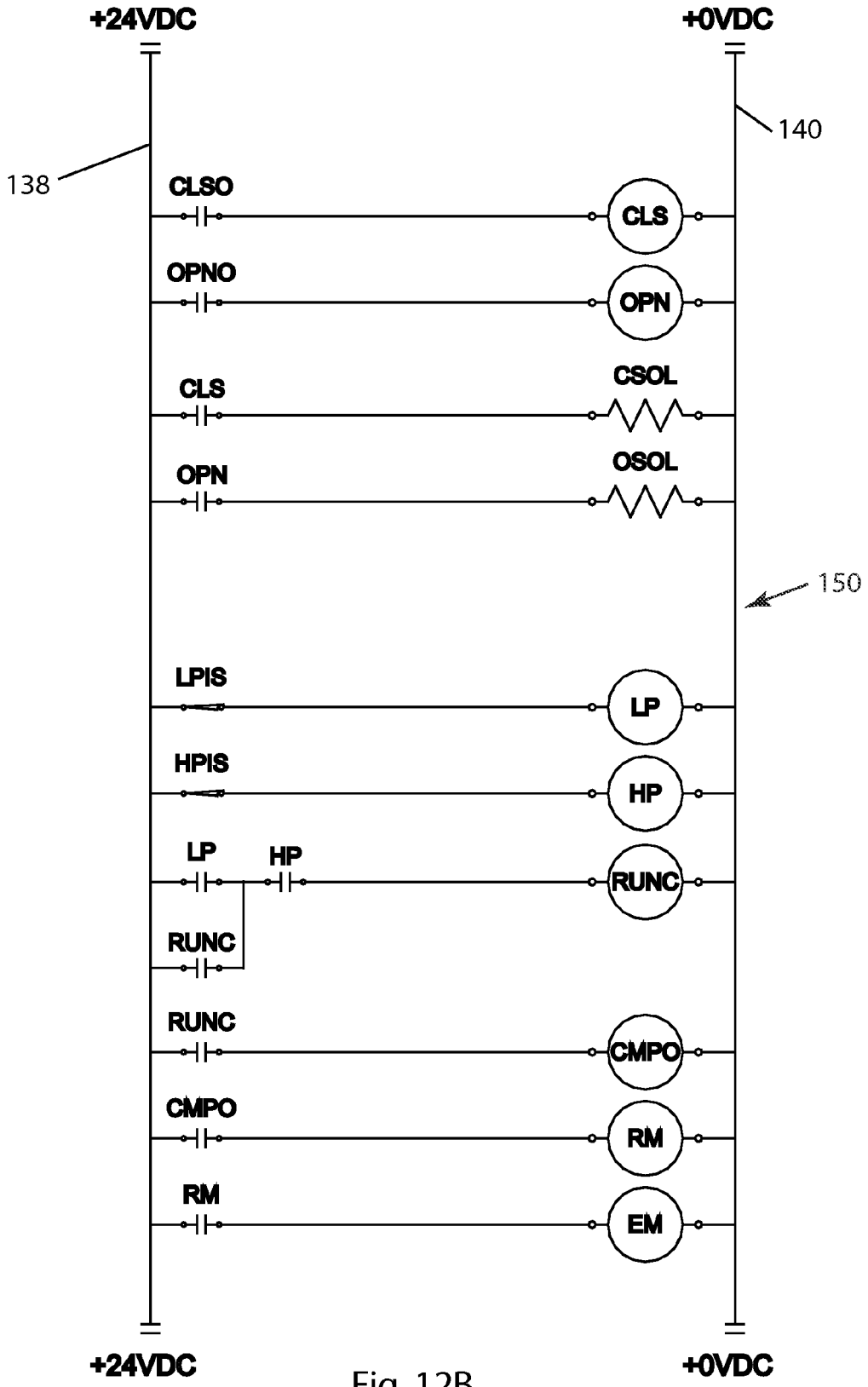
Figure 12C:
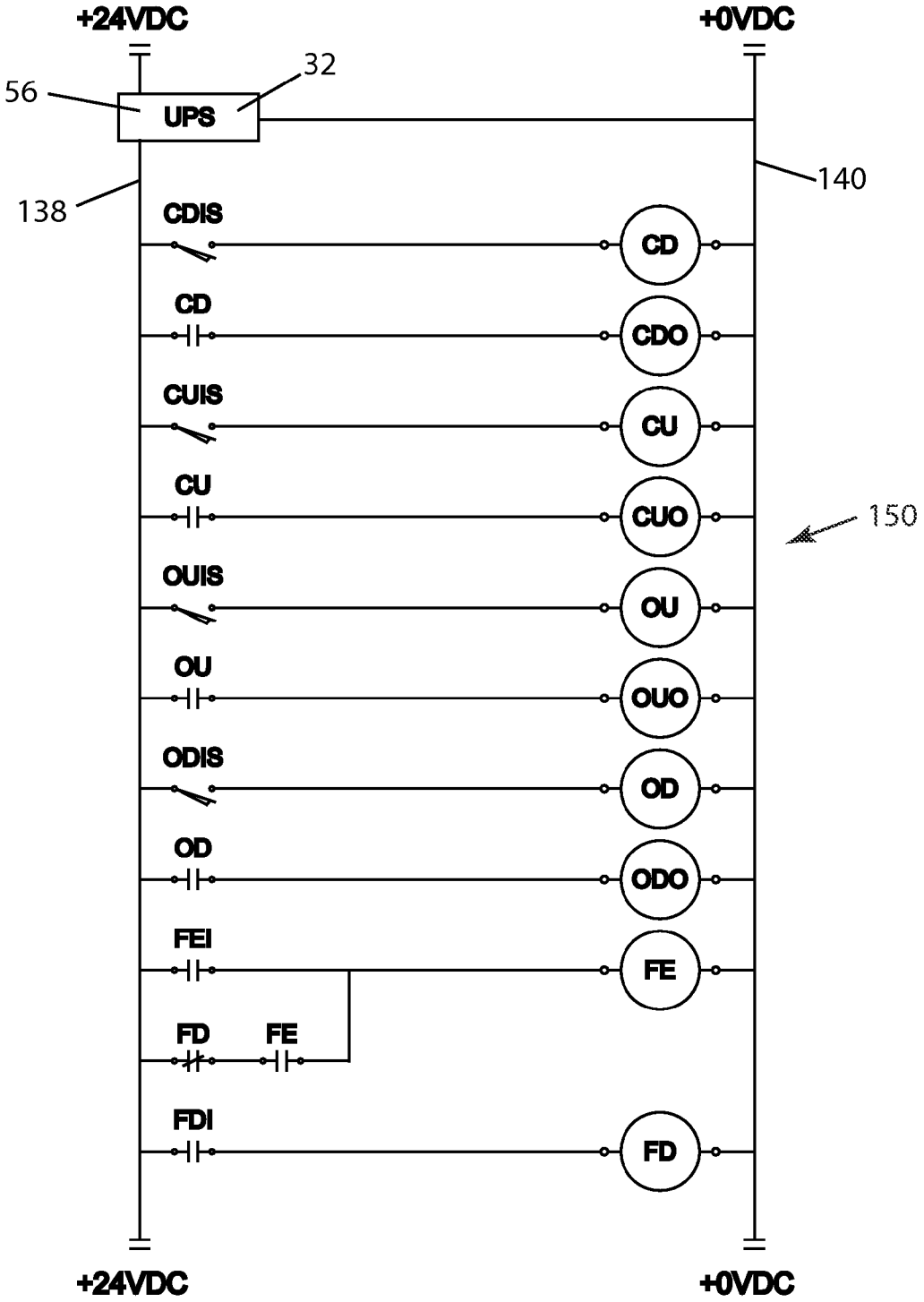
Figure 12D:
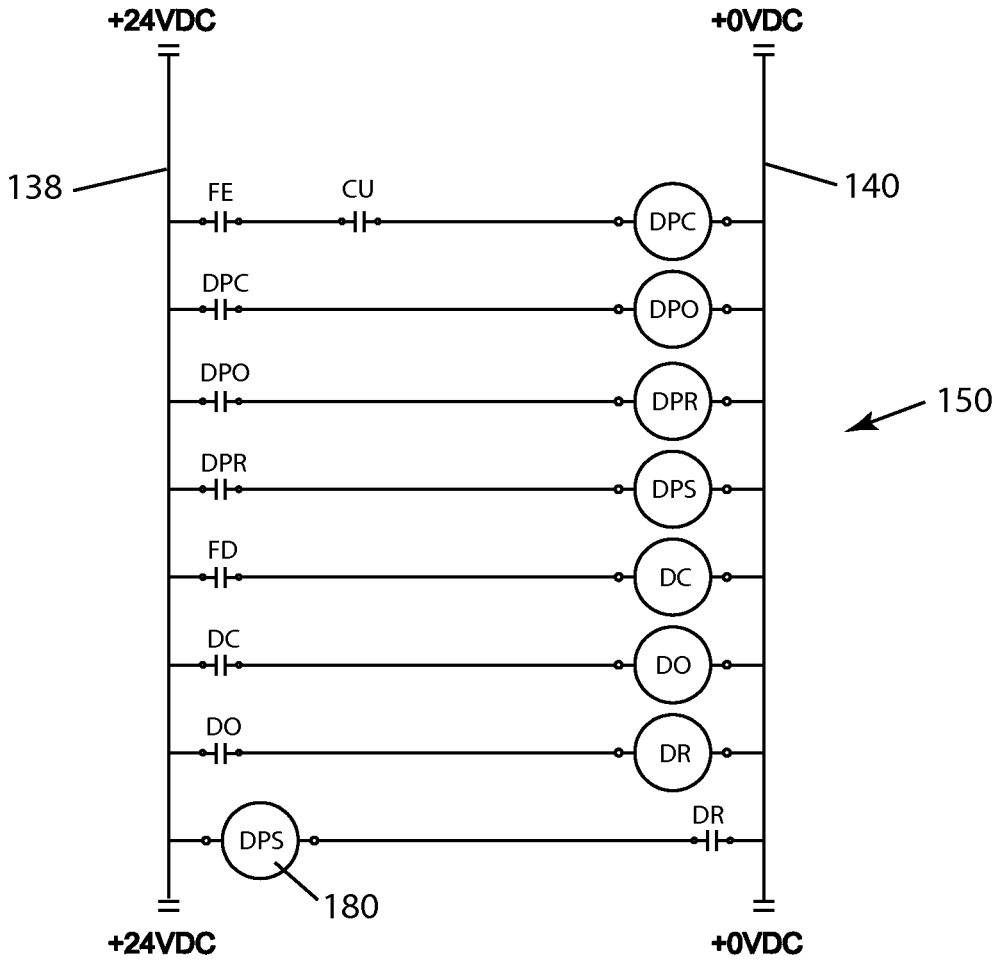

FIG. 12D, illustrating the control of deadlock prevention latching solenoids 180 (DPS), is identical in function to the similar portion of controller 34 in FIG. 8C.

FIG. 13 is a pneumatic circuit schematic diagram for a pneumatic-cylinder-driven embodiment of the sliding door apparatus of FIG. 1. In the embodiment of FIG. 13, a pneumatic cylinder 44 with piston 58*p* drive slide plate 52 and door 14. Controller 150 (see FIGS. 12A-12D) controls the movements of door 14 in a fashion similar to that of the pneumatic-motor-driven system of FIG. 11. Regulators 170 are set to slightly different pressure settings to compensate for the area ratio of piston 58*p*.

Figure 14:
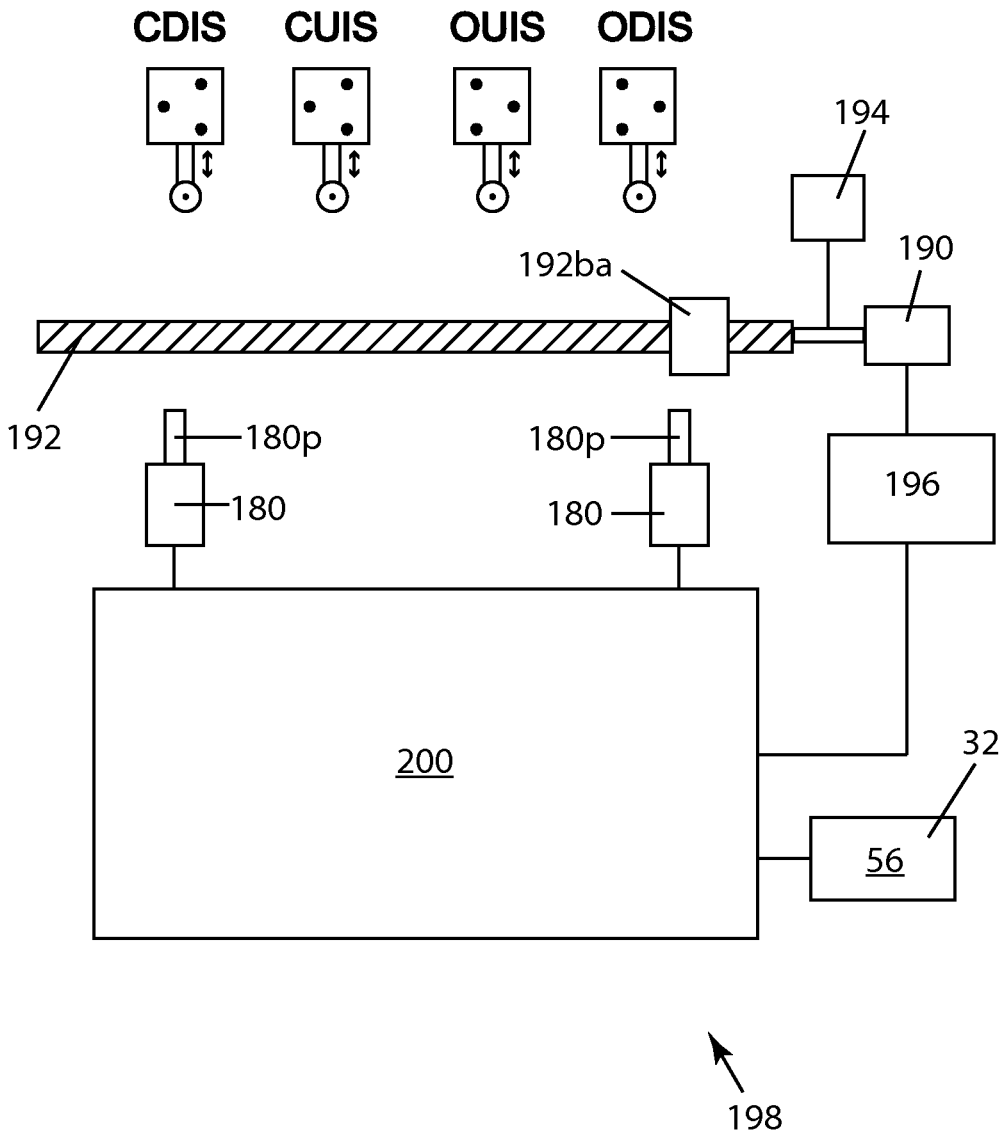
FIG. 14 is a schematic illustration of an electrically-driven embodiment of the sliding door apparatus of FIG. 1.

FIG. 14 is a schematic illustration of an electrically-driven embodiment for the control of sliding door apparatus 10. Bi-directional effector 30 is electric motor 190 mechanically linked to slide plate 52 (not shown in FIG. 14) with ballscrew 192 through a ball assembly 192*ba* of ballscrew 192. A controller 198 controls the actions of sliding door apparatus 10. Motor 190 is driven through a motor driver 196, and a motor position sensor 194 may be used to provide feedback to controller 198. Sensor 194 may be an optical shaft encoder, a linear position sensor connected to ball assembly 192*ba* or any of a number of other sensor types, all well-known to those skilled in the art of instrumentation. Limit sensors 36 may be used in this embodiment in a fashion similar to each of the previously-described embodiments of sliding door apparatus 10. Note that for simplicity of the diagrams, as in the cases of the schematics of the embodiments of FIGS. 7, 10, 11 and 13, limit switches 36 are not shown as "wired" into controller 198, although electrical connections are present in the physical hardware of all such embodiments represented in these figures. Uninterruptible power supply 56 provides power to sliding door apparatus 10.

Motor 190 may drive slide plate 52 with many other types of mechanical linkages such as a rack and pinion arrangement similar to the rotary hydraulic and pneumatic embodiments.

Controller 198 in FIG. 14 includes programmable computer device 200 programmed to control the movement of slide plate 52 in the same fashion as described in the other embodiments of sliding door apparatus 10 above. Input commands from an external source (not shown) include: closed and locked; closed and unlocked; open and locked; and open and unlocked. Computer 200 is programmed to direct the driving of slide plate 52 (and thus door 14) to the commanded positions. Limit sensors 36 indicate when the desired positions are reached, and position sensor 194 may be used to provide additional feedback to controller 198 regarding the position and/or speed of slide plate 52. Programming to achieve the desired action of sliding door apparatus 10 is well-known to those skilled in the art of motor control.

Controller 198 also includes two deadlock prevention latching solenoids 180 which are controlled by programmed controller 198 to latch plungers 180*p* against stops 182 (see FIG. 5) to prevent movement of slide plate 52 to move to deadlocked positions (open or closed).

While the principles of this invention have been described in connection with specific embodiments, it should be understood clearly that these descriptions are made only by way of example and are not intended to limit the scope of the invention.

The invention claimed is:

1. High-security sliding door apparatus for closing and opening a corridor, the apparatus including: (a) a high-security sliding door for use in a correctional institution, the sliding door having top and bottom edges, (b) a door frame having a track adjacent to the top edge of the door, (c) a carriage secured to the top edge of the door and having track-engaging rollers, and (d) a drive mechanism for opening and closing movement of the door, the drive mechanism including:

a bi-directional effector secured inside the frame;

a slide plate slideably secured to the carriage and having two end sections and being driven by the effector;

a position sensor for sensing position of the slide plate;

a power-storing power source; and a controller configured to enable the door to be continuously closed but not locked when a continuously-closed signal is received by the controller, wherein the controller is further configured to control the movement of the slide plate.

2. The sliding door apparatus of claim 1 wherein the bi-directional effector is a hydraulic motor and the apparatus further includes:

an electrically-driven hydraulic pump secured with respect to the frame;

a rack secured with respect to the slide plate;

a pinion driven by the hydraulic motor and engaging the rack; and the power-storing power source is an electrical uninterruptible power supply.

3. The sliding door apparatus of claim 1 wherein the bi-directional effector is a hydraulic cylinder having a piston and the apparatus further includes:

an electrically-driven hydraulic pump secured with respect to the frame;

the piston is secured with respect to the slide plate; and the power-storing power source is an electrical uninterruptible power supply.

4. The sliding door apparatus of claim 1 wherein the bi-directional effector is a pneumatic motor and the apparatus further includes:

a pneumatic connection to a compressed air source, the connection secured with respect to the frame;

a rack secured with respect to the slide plate; and a pinion driven by the pneumatic motor and engaging the rack.

5. The sliding door apparatus of claim 1 wherein the bi-directional effector is a pneumatic cylinder having a piston and the apparatus further includes:

a pneumatic connection to a compressed air source, the connection secured with respect to the frame; and the piston is secured with respect to the slide plate.

6. The sliding door apparatus of claim 1 wherein the bi-directional effector is an electric motor and the apparatus further includes:

a mechanical linkage between the electric motor and the sliding door; and the power-storing power source is an electrical uninterruptible power supply.

7. The sliding door apparatus of claim 1 wherein the slide plate includes:

a cam slot parallel to the direction of the door opening and closing movement and spanning the slide plate between the two end sections, the cam slot having a slot end in each of the end sections, the slot ends each including an end portion positioned below a spanning portion of the cam slot and a ramp portion connecting each end portion with its corresponding ramp portion such that the cam slot is a continuous slot between the two end portions; and at least one limit slot parallel to the cam slot, each limit slot having a lock-limit end at each end of the limit slot and having a length at least as long as the length of the end portion plus the horizontal length of the ramp portion;

a vertical lock bar slidably secured to the frame and having:

an upper end;

a lower end; and a cam follower secured to the upper end of the lock bar and configured to engage the cam slot;

a limit pin for each of the at least one limit slots, the limit pins secured with respect to the door and configured to engage its limit slot; and a lower-locked-open notch and a lower-locked-closed notch both fixed with respect to the frame and configured such that the lower-locked-open notch receives the lower end of the lock bar when the door is in a locked-open position and the lower-locked-closed notch receives the lower end of the lock bar when the door is in a locked-closed position.

8. The sliding door apparatus of claim 7 further including a upper-locked-open notch and a upper-locked-closed notch both fixed with respect to the frame and configured such that the upper-locked-open notch receives the upper end of the lock bar when the door is in a locked-open position and the upper-locked-closed notch receives the upper end of the lock bar when the door is in a locked-closed position.

9. The sliding door apparatus of claim 7 wherein the frame further comprises a receiver assembly, the receiver assembly including:

a receiver strip configured to receive a vertical forward edge of the door when the door is in a closed position;

a power-source chamber to hold the power source; and a key switch to enable a user to operate the door with a key.

10. The sliding door apparatus of claim 7 wherein the bi-directional effector is a hydraulic motor and the apparatus further includes:

an electrically-driven hydraulic pump secured with respect to the frame;

a rack secured with respect to the slide plate;

a pinion driven by the hydraulic motor and engaging the rack; and the power-storing power source is an electrical uninterruptible power supply.

11. The sliding door apparatus of claim 7 wherein the bi-directional effector is a hydraulic cylinder having a piston and the apparatus further includes:

an electrically-driven hydraulic pump secured with respect to the frame;

the piston is secured with respect to the slide plate; and the power-storing power source is an electrical uninterruptible power supply.

12. The sliding door apparatus of claim 7 wherein the bi-directional effector is a pneumatic motor and the apparatus further includes:

a pneumatic connection to a compressed air source, the connection secured with respect to the frame;

a rack secured with respect to the slide plate; and a pinion driven by the pneumatic motor and engaging the rack.

13. The sliding door apparatus of claim 7 wherein the bi-directional effector is a pneumatic cylinder having a piston and the apparatus further includes:

a pneumatic connection to a compressed air source, the connection secured with respect to the frame; and the piston is secured with respect to the slide plate.

14. The sliding door apparatus of claim 7 wherein the bi-directional effector is an electric motor and the apparatus further includes:

a mechanical linkage between the electric motor and the slide plate; and the power-storing power source is an electrical uninterruptible power supply.

15. The sliding door apparatus of claim 1 further including two latching solenoids to prevent the slide plate from moving beyond the carriage to a deadlock position.

* * * * *